US008834200B2

(12) United States Patent
Shaw

(10) Patent No.: US 8,834,200 B2
(45) Date of Patent: Sep. 16, 2014

(54) COMPRESSION TYPE COAXIAL F-CONNECTOR WITH TRAVELING SEAL AND GROOVED POST

(71) Applicant: Glen David Shaw, Conway, AR (US)

(72) Inventor: Glen David Shaw, Conway, AR (US)

(73) Assignee: Perfectvision Manufacturing, Inc., Little Rock, AR (US)

( * ) Notice: Subject to any disclaimer, the term of this patent is extended or adjusted under 35 U.S.C. 154(b) by 33 days.

(21) Appl. No.: 13/764,360

(22) Filed: Feb. 11, 2013

(65) Prior Publication Data

US 2013/0149884 A1 Jun. 13, 2013

Related U.S. Application Data

(63) Continuation-in-part of application No. 12/927,424, filed on Nov. 15, 2010, now Pat. No. 8,371,874, which is a continuation-in-part of application No. 12/380,327, filed on Feb. 26, 2009, now Pat. No. 7,841,896, which is a continuation-in-part of application No. 12/002,261, filed on Dec. 17, 2007, now Pat. No. 7,513,795.

(51) Int. Cl.

| | |
|---|---|
| ***H01R 13/46*** | (2006.01) |
| ***H01R 13/52*** | (2006.01) |
| ***H01R 9/05*** | (2006.01) |
| *H01R 101/00* | (2006.01) |

(52) U.S. Cl.

CPC ..... *H01R 13/46* (2013.01); *H01R 13/5205* (2013.01); *H01R 2101/00* (2013.01); *H01R 9/0524* (2013.01)

USPC ..... 439/578

(58) Field of Classification Search

USPC ..... 439/171, 172, 585, 578, 579

See application file for complete search history.

(56) References Cited

U.S. PATENT DOCUMENTS

| | | | | |
|---|---|---|---|---|
| 2,280,728 | A | 4/1942 | Streib | |
| D148,897 | S | 3/1948 | Ward | |
| 2,757,351 | A | 7/1956 | Klostermann | |
| D181,302 | S | 10/1957 | Logan | |
| 2,858,358 | A | 10/1958 | Hawke | |
| 3,184,706 | A * | 5/1965 | Atkins | 439/584 |
| 3,199,061 | A | 8/1965 | Johnson | |
| 3,292,136 | A | 12/1966 | Somerset | |

(Continued)

FOREIGN PATENT DOCUMENTS

| | | |
|---|---|---|
| EP | 0542102 | 5/1993 |
| WO | WO 9014697 | 11/1990 |

(Continued)

*Primary Examiner* — Alexander Gilman

(74) *Attorney, Agent, or Firm* — Stephen D. Carver

(57) ABSTRACT

Axially compressible, self-sealing, high bandwidth F-connectors for conventional hand tools for interconnection with coaxial cable. An internal, dual segment sealing grommet activated by compression elongates and deforms to provide a travelling seal. Each connector has a rigid nut that is rotatably secured to a, tubular body. A rigid, conductive post has a barbless shank with a groove that coaxially extends through the connector and penetrates the coaxial cable within the connector. A tubular, metallic end cap is slidably fitted to a body shank, and is thereafter forcibly compressed lengthwise during installation. The end cap has a ring groove for seating the enhanced grommet. The grommet travels and extrudes during compression to mate and intermingle with a portion of the cable braid that is looped back from a prepared cable end, and portions of the cable are urged towards the post groove for sealing.

17 Claims, 24 Drawing Sheets

(56) References Cited

U.S. PATENT DOCUMENTS 3,332,052 A 7/1967 Rusinyak
3,373,243 A 3/1968 Janowiak
3,375,485 A 3/1968 Donohue
3,448,430 A 6/1969 Kelly
3,498,647 A 3/1970 Schroder
3,512,224 A 5/1970 Newton
3,522,576 A 8/1970 Cairns
3,537,065 A 10/1970 Winston
3,609,637 A 9/1971 Cole
3,665,371 A 5/1972 Cripps
3,668,612 A 6/1972 Nepovim
3,671,922 A 6/1972 Zerlin
3,671,926 A 6/1972 Nepovim
3,678,445 A 7/1972 Brancaleone
3,678,446 A 7/1972 Siebelist
3,681,739 A 8/1972 Kornick
3,686,623 A 8/1972 Nijman
3,710,005 A 1/1973 French
3,739,076 A 6/1973 Schwartz
3,740,453 A 6/1973 Callaghan
3,835,443 A 9/1974 Arnold
3,846,738 A 11/1974 Nepovim
3,879,102 A 4/1975 Horak
3,976,352 A 8/1976 Spinner
D241,341 S 9/1976 Oxley
3,985,418 A 10/1976 Spinner
3,986,737 A 10/1976 Krusche
4,106,839 A 8/1978 Cooper
4,128,293 A 12/1978 Oaoli
4,280,749 A 7/1981 Hemmer
4,329,540 A 5/1982 Howarth
4,330,166 A 5/1982 Cooper
4,423,919 A 1/1984 Hillis
4,426,127 A 1/1984 Kubota
4,525,000 A 6/1985 Bachle
4,531,805 A 7/1985 Werth
4,583,811 A 4/1986 McMills
4,593,964 A 6/1986 Forney, Jr.
4,630,806 A 12/1986 Dan
4,648,684 A 3/1987 Mattis
4,684,201 A 8/1987 Hutter
4,698,028 A 10/1987 Caro
4,703,988 A 11/1987 Raux
4,746,305 A 5/1988 Nomura
RE32,787 E 11/1988 Gallusser
4,808,128 A 2/1989 Werth
4,813,716 A 3/1989 Lalikos
4,834,675 A 5/1989 Samchisen
4,936,788 A 6/1990 Lin
4,952,174 A 8/1990 Sucht
D313,222 S 12/1990 Takizawa
4,979,911 A 12/1990 Spencer
4,990,106 A 2/1991 Szegda
5,002,503 A * 3/1991 Campbell et al. ..... 439/578
5,011,422 A 4/1991 Yeh
5,024,606 A 6/1991 Ming
5,043,696 A 8/1991 Wang
5,066,248 A 11/1991 Gaver, Jr.
5,078,623 A 1/1992 Wang
5,083,943 A 1/1992 Tarrant
5,088,936 A 2/1992 Wang
5,112,250 A 5/1992 Wang
D327,872 S 7/1992 McMillset al.
5,167,525 A 12/1992 Wang
5,167,536 A 12/1992 Wang
5,192,226 A 3/1993 Wang
5,219,299 A 6/1993 Wang
5,226,838 A 7/1993 Hsu
D339,568 S 9/1993 Salz
5,270,487 A 12/1993 Sawamura
5,321,207 A 6/1994 Huang
5,340,325 A 8/1994 Pai
5,342,096 A 8/1994 Bachle
5,383,798 A 1/1995 Lin
5,387,116 A 2/1995 Wang
5,387,127 A 2/1995 Wang
5,389,012 A 2/1995 Huang
5,397,252 A 3/1995 Wang
5,413,502 A 5/1995 Wang
5,430,618 A 7/1995 Huang
5,438,251 A 8/1995 Chen
5,470,257 A 11/1995 Szegda
5,478,258 A 12/1995 Wang
5,498,175 A 3/1996 Yeh
5,599,198 A 2/1997 Wang
5,600,094 A 2/1997 McCabe
5,613,880 A 3/1997 Wang
5,632,651 A * 5/1997 Szegda ..... 439/578
5,667,409 A 9/1997 Wong
5,683,263 A 11/1997 Hsu
5,702,261 A 12/1997 Wang
5,722,856 A 3/1998 Fuchs
5,723,818 A 3/1998 Yeh
5,730,621 A 3/1998 Wang
5,769,652 A 6/1998 Wider
5,803,757 A 9/1998 Wang
5,820,408 A 10/1998 Wang
5,863,226 A 1/1999 Lan
5,879,166 A 3/1999 Wang
5,924,889 A 7/1999 Wang
5,934,137 A 8/1999 Tarpill
5,951,319 A 9/1999 Lin
5,957,730 A 9/1999 Wang
5,975,949 A 11/1999 Holliday
5,975,951 A * 11/1999 Burris et al. ..... 439/585
5,980,308 A 11/1999 Hu
5,997,350 A 12/1999 Burris
6,024,588 A 2/2000 Hsu
6,065,976 A 5/2000 Wang
6,095,869 A 8/2000 Wang
6,113,431 A 9/2000 Wong
6,139,344 A 10/2000 Wang
6,146,197 A 11/2000 Holliday
6,153,830 A 11/2000 Montena
6,159,046 A 12/2000 Wong
D436,076 S 1/2001 Montena
6,179,656 B1 1/2001 Wong
D437,826 S 2/2001 Montena
D440,539 S 4/2001 Montena
D440,939 S 4/2001 Montena
6,234,838 B1 5/2001 Wong
6,276,970 B1 8/2001 Wong
6,287,148 B1 9/2001 Huang
6,332,815 B1 12/2001 Bruce
6,386,912 B1 5/2002 Li
6,390,840 B1 5/2002 Wang
D458,904 S 6/2002 Montena
6,402,155 B2 6/2002 Sakata
6,406,330 B2 6/2002 Bruce
D460,739 S 7/2002 Fox
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,478,599 B1 11/2002 Lee
6,478,618 B2 11/2002 Wong
6,488,317 B1 12/2002 Daoud
D468,696 S 1/2003 Montena
6,530,807 B2 3/2003 Rodrigues
6,558,194 B2 5/2003 Montena
D475,975 S 6/2003 Fox
D475,976 S 6/2003 Montena
D475,977 S 6/2003 Montena
6,634,906 B1 10/2003 Yeh
6,676,443 B1 1/2004 Wang
6,716,062 B1 4/2004 Palinkas
6,733,336 B1 5/2004 Montena
6,767,247 B2 7/2004 Rodrigues
6,767,248 B1 7/2004 Hung
6,767,249 B1 7/2004 Li
6,769,926 B1 8/2004 Montena
6,776,650 B2 8/2004 Cheng

(56) References Cited

U.S. PATENT DOCUMENTS

| | | | | |
|---|---|---|---|---|
| 6,776,657 | B1 | 8/2004 | Hung | |
| 6,776,665 | B2 | 8/2004 | Huang | |
| 6,780,052 | B2 | 8/2004 | Montena | |
| 6,789,653 | B1 | 9/2004 | Hsu | |
| 6,793,526 | B1 | 9/2004 | Hsu | |
| 6,799,995 | B2 | 10/2004 | Hsu | |
| 6,805,584 | B1 | 10/2004 | Chen | |
| 6,817,897 | B2 | 11/2004 | Chee | |
| 6,830,479 | B2 | 12/2004 | Holliday | |
| 6,848,939 | B2 | 2/2005 | Stirling | |
| 6,848,940 | B2 | 2/2005 | Montena | |
| 6,860,751 | B1 | 3/2005 | Huang | |
| D503,685 | S | 4/2005 | Montena | |
| D504,113 | S | 4/2005 | Montena | |
| D504,114 | S | 4/2005 | Montena | |
| D504,402 | S | 4/2005 | Montena | |
| 6,881,075 | B2 | 4/2005 | Huang | |
| 6,884,113 | B1 | 4/2005 | Montena | |
| D505,391 | S | 5/2005 | Rodrigues | |
| 6,887,090 | B2 | 5/2005 | Lin | |
| D506,446 | S | 6/2005 | Montena | |
| 6,908,337 | B1 | 6/2005 | Li | |
| 6,910,919 | B1 | 6/2005 | Hung | |
| D507,242 | S | 7/2005 | Montena | |
| 6,929,501 | B2 | 8/2005 | Huang | |
| 6,929,507 | B2 | 8/2005 | Lin | |
| 6,935,874 | B1 | 8/2005 | Fang | |
| 6,935,878 | B2 | 8/2005 | Hsu | |
| 6,948,969 | B2 | 9/2005 | Huang | |
| 6,948,973 | B1 | 9/2005 | Hsu | |
| 6,951,469 | B1 | 10/2005 | Lin | |
| 6,956,464 | B2 | 10/2005 | Wang | |
| D511,497 | S | 11/2005 | Murphy | |
| D511,498 | S | 11/2005 | Holliday | |
| D512,024 | S | 11/2005 | Murphy | |
| D512,689 | S | 12/2005 | Murphy | |
| D513,406 | S | 1/2006 | Rodrigues | |
| D513,736 | S | 1/2006 | Fox | |
| D514,071 | S | 1/2006 | Vahey | |
| D515,037 | S | 2/2006 | Fox | |
| 6,994,588 | B2 | 2/2006 | Montena | |
| 7,001,204 | B1 | 2/2006 | Lin | |
| 7,004,765 | B2 | 2/2006 | Hsu | |
| 7,004,777 | B2 | 2/2006 | Hsu | |
| 7,008,263 | B2 | 3/2006 | Holland | |
| 7,018,235 | B1 | 3/2006 | Burris | |
| D518,772 | S | 4/2006 | Fox | |
| D519,076 | S | 4/2006 | Fox | |
| D519,451 | S | 4/2006 | Fox | |
| D519,452 | S | 4/2006 | Rodrigues | |
| D519,453 | S | 4/2006 | Rodrigues | |
| D519,463 | S | 4/2006 | Tamezane | |
| 7,021,965 | B1 | 4/2006 | Montena | |
| D521,454 | S | 5/2006 | Murphy | |
| D521,930 | S | 5/2006 | Fox | |
| 7,063,551 | B1 | 6/2006 | Lin | |
| 7,114,990 | B2 | 10/2006 | Bence | |
| 7,118,416 | B2 | 10/2006 | Montena | |
| 7,128,603 | B2 | 10/2006 | Burris | |
| D535,259 | S | 1/2007 | Rodrigues | |
| 7,182,639 | B2 | 2/2007 | Burris | |
| 7,192,308 | B2 | 3/2007 | Rodrigues | |
| D543,948 | S | 6/2007 | Montena | |
| D544,837 | S | 6/2007 | Disbennett | |
| 7,241,172 | B2 | 7/2007 | Rodrigues | |
| 7,252,546 | B1 | 8/2007 | Holland | |
| 7,255,598 | B2 | 8/2007 | Montena | |
| 7,288,002 | B2 | 10/2007 | Rodrigues | |
| 7,303,436 | B1 | 12/2007 | Li | |
| 7,354,462 | B2 | 4/2008 | Holland | |
| 7,364,462 | B2 | 4/2008 | Holland | |
| 7,371,113 | B2 | 5/2008 | Burris | |
| 7,479,035 | B2 | 1/2009 | Bence | |
| 7,507,117 | B2 | 3/2009 | Amidon | |
| 7,513,795 | B1 * | 4/2009 | Shaw | 439/578 |
| D601,966 | S | 10/2009 | Shaw | |
| D601,967 | S | 10/2009 | Shaw | |
| D607,826 | S | 1/2010 | Shaw | |
| D607,827 | S | 1/2010 | Shaw | |
| D607,828 | S | 1/2010 | Shaw | |
| D607,829 | S | 1/2010 | Shaw | |
| D607,830 | S | 1/2010 | Shaw | |
| D608,294 | S | 1/2010 | Shaw | |
| 7,753,705 | B2 * | 7/2010 | Montena | 439/277 |
| 7,824,216 | B2 | 11/2010 | Purdy | |
| 7,841,896 | B2 * | 11/2010 | Shaw et al. | 439/578 |
| 7,845,976 | B2 * | 12/2010 | Mathews | 439/578 |
| 7,892,005 | B2 | 2/2011 | Haube | |
| 7,892,024 | B1 | 2/2011 | Chen | |
| 7,931,509 | B2 | 4/2011 | Shaw | |
| 7,955,126 | B2 * | 6/2011 | Bence et al. | 439/583 |
| 8,192,237 | B2 | 6/2012 | Purdy | |
| 8,371,874 | B2 * | 2/2013 | Shaw et al. | 439/578 |
| 2002/0146935 | A1 | 10/2002 | Wong | |
| 2003/0092319 | A1 | 5/2003 | Hung | |
| 2003/0194902 | A1 | 10/2003 | Huang | |
| 2003/0236027 | A1 | 12/2003 | Wang | |
| 2004/0053533 | A1 | 3/2004 | Huang | |
| 2004/0067688 | A1 | 4/2004 | Cheng | |
| 2004/0077215 | A1 | 4/2004 | Palinkas | |
| 2004/0102095 | A1 | 5/2004 | Huang | |
| 2004/0147164 | A1 | 7/2004 | Li | |
| 2004/0171297 | A1 | 9/2004 | Hsu | |
| 2004/0171315 | A1 | 9/2004 | Liao | |
| 2004/0224556 | A1 | 11/2004 | Qin | |
| 2005/0009379 | A1 | 1/2005 | Huang | |
| 2005/0020121 | A1 | 1/2005 | Lin | |
| 2005/0032410 | A1 | 2/2005 | Huang | |
| 2005/0070145 | A1 | 3/2005 | Huang | |
| 2005/0075012 | A1 | 4/2005 | Hsu | |
| 2005/0153587 | A1 | 7/2005 | Hsu | |
| 2005/0159030 | A1 | 7/2005 | Hsu | |
| 2005/0186852 | A1 | 8/2005 | Hsu | |
| 2005/0186853 | A1 | 8/2005 | Hsu | |
| 2005/0202690 | A1 | 9/2005 | Lien | |
| 2005/0202699 | A1 | 9/2005 | Hsu | |
| 2005/0233632 | A1 | 10/2005 | Hsu | |
| 2005/0250357 | A1 | 11/2005 | Chen | |
| 2005/0260894 | A1 | 11/2005 | Chen | |
| 2006/0094300 | A1 | 5/2006 | Hsu | |
| 2006/0110977 | A1 | 5/2006 | Matthews | |
| 2006/0121753 | A1 | 6/2006 | Chiang | |
| 2006/0121763 | A1 | 6/2006 | Chiang | |
| 2006/0292926 | A1 | 12/2006 | Chee | |
| 2008/0248689 | A1 | 10/2008 | Montena | |
| 2009/0098770 | A1 | 4/2009 | Bence | |
| 2009/0170360 | A1 * | 7/2009 | Shaw et al. | 439/277 |
| 2011/0021072 | A1 | 1/2011 | Purdy | |
| 2011/0065317 | A1 * | 3/2011 | Shaw et al. | 439/578 |
| 2012/0045933 | A1 | 2/2012 | Youtsey | |
| 2012/0270428 | A1 | 10/2012 | Purdy | |
| 2013/0149884 | A1 * | 6/2013 | Shaw | 439/275 |

FOREIGN PATENT DOCUMENTS

| | | |
|---|---|---|
| WO | WO 93/05547 | 3/1993 |
| WO | WO 93/24973 | 12/1993 |
| WO | WO 96/20516 | 7/1996 |
| WO | WO 96/20518 | 7/1996 |
| WO | WO 97/22162 | 6/1997 |
| WO | WO/99/65117 | 12/1999 |
| WO | WO/99/65118 | 12/1999 |
| WO | WO/03/096484 | 11/2003 |
| WO | WO/2005/083845 | 9/2005 |

* cited by examiner

COMPRESSION TYPE COAXIAL F-CONNECTOR WITH TRAVELING SEAL AND GROOVED POST

CROSS REFERENCE TO RELATED APPLICATION

This is a Continuation-in-Part application based upon a prior U.S. utility patent application entitled "Compression Type Coaxial Cable F-Connectors with Traveling Seal and Barbless Post," filed Nov. 15, 2010, Ser. No. 12/927,424, which was a Continuation-in-Part application based upon a prior U.S. utility patent application entitled "Sealed Compression Type Coaxial Cable F-Connectors," filed Feb. 26, 2009, Ser. No. 12/380,327, now U.S. Pat. No. 7,841,896, issued Nov. 30, 2010, which was a Continuation-in-Part of an application entitled "Compression Type Coaxial Cable F-Connectors," Ser. No. 12/002,261, filed Dec. 17, 2007, now U.S. Pat. No. 7,513,795, issued Apr. 7, 2009.

BACKGROUND OF THE INVENTION

1. Field of the Invention

The present invention relates generally to electrical connectors for coaxial cables and related electrical fittings. More particularly, the present invention relates to coaxial F-connectors of the axial compression type which are adapted to be installed with hand compression tools, and specifically to F-connectors that are internally sealed when compressed. Known prior art of relevance is classified in U.S. Pat. No. Class 439, Subclasses 349, 578-584.

2. Description of the Related Art

A variety of coaxial cable connectors have been developed in the electronic arts for interfacing coaxial cable with various fittings. Famous older designs that are well known in the art, such as the Amphenol PL-259 plug, require soldering and the hand manipulation of certain components during installation. One advantage of the venerable PL-259 includes the adaptability for both coaxial cables of relatively small diameter, such as RG-59U or RG-58U, and large diameter coaxial cable (i.e., such as RG-8U, RG-9U, LMR-400 etc.). So-called N-connectors also require soldering, but exhibit high frequency advantages. Numerous known connectors are ideal for smaller diameter coaxial cable, such as RG-58U and RG-59U. Examples of the latter include the venerable "RCA connector", which also requires soldering, and the well known "BNC connector", famous for its "bayonet connection", that also requires soldering with some designs.

Conventional coaxial cables typically comprise a solid or stranded center conductor surrounded by a plastic, dielectric insulator and a coaxial shield of braided copper and foil. An outer layer of insulation, usually black in color, coaxially surrounds the cable. To prepare coaxial cable for connector installation, a small length of the jacket is removed, exposing a portion of the outer conductive shield that is drawn back and coaxially positioned. A portion of the insulated center is stripped so that an exposed portion of the inner copper conductor can become the male prong of the assembled F-connector. Experienced installers are well versed in the requirements for making a "prepared end" of a coaxial line for subsequent attachment to a compression F-connector.

The modern F-type coaxial cable connector has surpassed all other coaxial connector types in volume. These connectors are typically used in conjunction with smaller diameter coaxial cable, particularly RG-6 cable and the like. The demand for home and business wiring of cable TV system, home satellite systems, and satellite receiving antenna installations has greatly accelerated the use of low-power F-connectors. Typical F-connectors comprise multiple pieces. Typically, a threaded, hex-head nut screws into a suitable socket commonly installed on conventional electronic devices such as televisions, satellite receivers and accessories, satellite radios, and computer components and peripherals. The connector body mounts an inner, generally cylindrical post that extends coaxially rearwardly from the hex nut. Usually the post is barbed.

When a prepared end of the coaxial cable is inserted, the post penetrates the cable, sandwiching itself between the insulated cable center and the outer conductive braid. A deflectable, rear locking part secures the cable within the body of the connector after compression. The locking part is known by various terms in the art, including "cap", or "bell" or "collar" or "end sleeve" and the like. The end cap, which may be formed of metal or a resilient plastic, is compressed over or within the connector body to complete the connection. A seal is internally established by one or more 0-rings or grommets. Suitable grommets may comprise silicone elastomer.

The design of modern F-connectors is advantageous. First, typical assembly and installation of many F-connector designs is completely solderless. As a result, installation speed increases. Further, typical F-connectors are designed to insure good electrical contact between components. The outer conductive braid for the coaxial cable, for example, is received within the F-connector, and frictional and/or compressive contact insures electrical continuity. For satellite and cable installations the desired F-connector design mechanically routes the inner, copper conductor of the coaxial cable through the connector body and coaxially out through the mouth of the connector nut to electrically function as the male portion of the connector junction without a separate part.

An important F-connector design innovation relates to the "compression-type" F-connector. Such designs typically comprise a metallic body pivoted to a hex-head nut for electrical and mechanical interconnection with a suitably threaded socket. A rigid, conductive post is coaxially disposed within the connector body, and is adapted to contact the conductive outer braid of the coaxial cable when the prepared cable end is installed. After insertion of the stripped end of the coax, the rear connector cap or collar is forcibly, axially compressed relative to the connector body. A suitable hand operated compression tool designed for compression F-connectors is desirable. Some connector designs have an end cap adapted to externally mount the body, and some designs use a rear cap that internally engages the F-connector body. In some designs the cap is metal, and in others it is plastic. In any event, after the cap is compressed, the braided shield in electrically connected and mechanically secured, and a tip of the exposed copper center conductor properly extends from the connector front. The conductive metallic coaxial cable braid compressively abuts internal metal components, such as the post, to insure proper electrical connections.

One popular modern trend with compression F-connectors involves their preassembly and packaging. In some preassembled designs the rear sleeve (i.e., or end cap, collar etc.) is compressively forced part-way onto or into the connector body prior to bulk packaging. The end sleeve is pre-connected to the connector end by the manufacturer to ease the job of the installer by minimizing or avoiding installation assembly steps. For example, when the installer reaches into his or her package of connectors, he or she need draw out only one part, or connector, and need not sort connector bodies from connector end caps or sleeves and assemble them in the field, since the device end cap is already positioned by the manufacturer. Because of the latter factors, installation speed is increased, and component complexity is reduced.

Typically, preassembled compression F-connector designs involve locking "detents" that establish two substantially fixed positions for the end cap along the length of the connector body. The cap, for example, may be provided with an internal lip that surmounts one or more annular ridges or grooves defined on the connector collar for the mechanical detent. In the first detent position, for example, the end cap yieldably assumes a first semi-fixed position coupled to the lip on the connector end, where it semi-permanently remains until use and installation. The connection force is sufficient to yieldably maintain the end cap in place as the F-connectors are manipulated and jostled about. During assembly, once a prepared cable end is forced through the connector and its end cap, the connector is placed within a preconfigured void within and between the jaws of a hand-operated compression installation tool, the handles of which can be squeezed to force the connector parts together. During compression, in detented designs, the end cap will be axially forced from the first detent position to a second, compressed and "installed" detent position.

High quality F-connectors are subject to demanding standards and requirements. Modern home satellite systems distribute an extremely wide band signal, and as the demand for high definition television signals increases, and as more and more channels are added, the bandwidth requirements are becoming even more demanding. At present, a goal in the industry is for F-connectors to reliably handle bandwidths approximating four GHz or more.

Disadvantages with prior art coaxial F-connectors are recognized. For example, moisture and humidity can interfere with electrical contact, degrading the signal pathway between the coax, the connector, and the fitting to which it is connected. For example, F-connectors use compression and friction to establish a good electrical connection between the braided shield of the coaxial cable and the connector body, as there is no soldering. Moisture infiltration, usually between the connector body and portions of the coaxial cable, can be detrimental. Signal degradation, impedance mismatching, and signal loss can increase over time with subsequent corrosion. Moisture infiltration often increases in response to mechanical imperfections resulting where coaxial compression connectors are improperly compressed.

Mechanical flaws caused by improper crimping or compression can also degrade the impedance or characteristic bandwidth of the connector, attenuating and degrading the required wide-band signal that modern TV satellite dish type receiving systems employ. If the axial compression step does not positively lock the end cap in a proper coaxial position, the end cap can shift and the integrity of the connection can suffer. Furthermore, particularly in modern, high-bandwidth, high-frequency applications involved with modern satellite applications distributing multiple high definition television channels, it is thought that radial deformation of internal coaxial parts, which is a natural consequence of radial compression F-connectors, potentially degrades performance.

Dealers and installers of satellite television equipment have created a substantial demand for stripping and installation tools for modern compression type F-connectors. However, installers typically minimize the weight and quantity of tools and connectors they carry on the job. There are a variety of differently sized and configured F-connectors, and a variety of different compression tools for installation.

On the one hand, F-connectors share the same basic shape and dimensions, as their connecting nut must mate with a standard thread, and the internal diameter of critical parts must accommodate standard coaxial cable. On the other hand, some compression F connectors jam the end sleeve or cap into the body, and some force it externally. Some connectors use a detent system, as mentioned above, to yieldably hold the end sleeve or cap in at least a first temporary position. Still other connectors require manual assembly of the end cap to the body of the connector. In other words, size differences exist in the field between the dimensions of different F-connectors, and the tools used to install them.

The typical installer carries as few tools as practicable while on the job. He or she may possess numerous different types of connectors. Particularly with the popularity of the "detented" type of compression F-connector, hand tools customized for specific connector dimensions have arisen. The internal compression volume of the hand tool must match very specific "before" and "after" dimensions of the connector for a precision fit. After a given compression F-connector is preassembled, then penetrated by the prepared end of a segment of coaxial cable, the tool must receive and properly "capture" the connector. The most popular compression tools are known as "saddle" types, or "fully enclosed" types. In either event the tool must be sized to comfortably receive and "capture" connectors of predetermined external dimensions. Tools are designed for proper compression deflection, so the connector assumes a correct, reduced length after compression. Popular tools known in the art are available from the Ripley Company, model 'Universal FX', the 'LCCT-1' made by International Communications, or the ICM 'VT200' made by the PPC Company.

Connector failures often result from small mechanical misalignments that result where the internal compression volume of the installation tool does not properly match the size of the captured connector. The degree of internal tool compression should closely correlate with the reduced length of the connector after axial deflection. In other words, the end sleeve or cap must be forcibly displaced a correct distance. Wear and tear over time can mismatch components. In other words, where hand tools designed for a specific connector length are used with connectors of slightly varying sizes, as would be encountered with different types or brands of connectors, improper and incomplete closure may result. Misdirected compression forces exerted upon the end cap or sleeve and the connector body or during compression can cause deformation and interfere with alignment. The asymmetric forces applied by a worn or mismatched saddle type compression tool can be particularly detrimental. Sometimes improper contact with internal grommets or O-rings results, affecting the moisture seal.

The chance that a given compression hand tool, used by a given installer, will mismatch the particular connectors in use at a given time is often increased when the connectors are of the "detent" type. Detented compression connectors, examples of which are discussed below, are designed to assume a predetermined length after both preassembly, and assembly. Thus detented F-connectors require a substantially mating compression tool of critical dimensions for proper performance. The chances that a given installer will install the requested compression F-connectors involved at a given job, or specified in a given installation contract, with the correctly sized, mating installation tool are less than perfect in reality. Another problem is that detented F-connector, even if sized correctly and matched with the correct installation tool, may not install properly unless the installer always exerts the right force by fully deflecting the tool handles. Even if a given installation tool is designed for the precise dimensions of the connectors chosen for a given job, wear and tear over the life of the hand tool can degrade its working dimensions and tolerances. Real world variables like these can conclude with an incorrectly installed connector that does not reach its intended or predetermined length after assembly.

If and when the chosen compression tool is not correctly matched to the F-connector, deformation and damage can occur during installation, particularly with detented compression F-connectors. Another problem occurs where an installer improperly positions the connector within the hand tool. Experienced installers, who may have configured and installed thousands of F-connectors over the years, often rely upon a combination of "look" and "feel" during installation when fitting connectors to the cable, and when positioning the connectors in the hand tool. Repetition and lack of attention tends to breed sloppiness and carelessness. Improper alignment and connector placement that can cause axial deformation. Sloppiness in preparing a cable end for the connector can also be detrimental.

A modern, compression type F-connector of the compression type is illustrated in U.S. Pat. No. 4,834,675 issued May 30, 1989 and entitled "Snap-n-seal Coaxial Connector." The connector has an annular compression sleeve, an annular collar which peripherally engages the jacket of a coaxial cable, an internal post coaxially disposed within the collar that engages the cable shield, and a rotatable nut at the front for connection. A displaceable rear cap is frangibly attached to the body front, and must be broken away for connector installation manually and then pre-positioned by the user on the connector end. The end cap is axially forced into coaxial engagement within the tubular compression sleeve between the jacket of the coaxial cable and the annular collar, establishing mechanical and electrical engagement between the connector body and the coaxial cable shield.

U.S. Pat. No. 5,632,651 issued May 27, 1997 and entitled "Radial compression type Coaxial Cable end Connector" shows a compression type coaxial cable end connector with an internal tubular inner post and an outer collar that cooperates in a radially spaced relationship with the inner post to define an annular chamber with a rear opening. A threaded head attaches the connector to a system component. A tubular locking cap protruding axially into the annular chamber through its rear is detented to the connector body and is displaceable axially between an open position accommodating insertion of the tubular inner post into a prepared cable end, with an annular outer portion of the cable being received in the annular chamber, and a clamped position fixing the annular cable portion within the chamber.

Similarly, U.S. Pat. No. 6,767,247 issued Jul. 27, 2004 depicts a compression F-connector of the detent type. A detachable rear cap or end sleeve temporarily snap fits or detents to a first yieldable position on the connector rear. This facilitates handling by the installer. The detachable end sleeve coaxially, penetrates the connector body when installed, and the coaxial cable shield is compressed between the internal connector post and the end sleeve.

U.S. Pat. No. 6,530,807 issued Mar. 11, 2003, and entitled "Coaxial connector having detachable Locking Sleeve," illustrates another modern compression F-connector. The connector includes a locking end cap provided in detachable, re-attachable snap engagement within the rear end of the connector body for securing the cable. The cable may be terminated to the connector by inserting the cable into the locking sleeve or the locking sleeve may be detachably removed from the connector body and the cable inserted directly into the cable body with the locking sleeve detached subsequently.

U.S. Pat. No. 5,470,257 issued Nov. 28, 1995 shows a detented, compression type coaxial cable connector. A tubular inner post is surrounded by an outer collar and linked to a hex head. The radially spaced relationship between the post and the collar defines an annular chamber into which a tubular locking cap protrudes, being detented in a first position that retains it attached to the connector. After the tubular inner post receives a prepared cable end, the shield locates within the annular chamber, and compression of the locking cap frictionally binds the parts together.

U.S. Pat. No. 6,153,830 issued Nov. 28, 2000 shows a compression F-connector with an internal post member, and a rear end cap that coaxially mounts over the cable collar or intermediate body portion. The internal, annular cavity coaxially formed between the post and the connector body is occupied by the outer conductive braid of the coaxial cable. The fastener member, in a pre-installed first configuration is movably fastened onto the connector body. The fastener member can be moved toward the nut into a second configuration in which the fastener member coacts with the connector body so that the connector sealingly grips the coaxial cable. U.S. Pat. No. 6,558,194 issued May 6, 2003 and entitled "Connector and method of Operation" and U.S. Pat. No. 6,780,052 issued Aug. 24, 2004 are similar.

U.S. Pat. No. 6,848,940 issued Feb. 1, 2005 shows a compression F-connector similar to the foregoing, but the compressible end cap coaxially mounts on the outside of the body.

Another detented compression F-connector is discussed in U.S. Pat. No. 6,848,940, issued Feb. 1, 2005 and entitled "Connector and method of Operation." The connector body coaxially houses an internal post that is coupled to the inner conductor of a coaxial cable. A nut is coupled to either the connector body or the post for the connecting to a device. The post has a cavity that accepts the center conductor and insulator core of a coaxial cable. The annulus between the connector body and the post locates the coaxial cable braid. The end cap or sleeve assumes a pre-installed first configuration temporarily but movably fastened to the connector body, a position assumed prior to compression and installation. The end cap can be axially forced toward the nut into an installed or compressed configuration in which it grips the coaxial cable.

Various hand tools that can crimp or compress F-connectors are known.

For example, U.S. Pat. No. 5,647,119 issued Jul. 15, 1997 and entitled "Cable terminating Tool" discloses a hand tool for compression type F-connectors. Pistol grip handles are pivotally displaceable. A pair of cable retainers pivotally supported on a tool holder carried by one of the handles releasably retains the cable end and a preattached connector in coaxial alignment with an axially moveable plunger. The plunger axially compresses the connector in response to handle deflection. The plunger is adjustable to adapt the tool to apply compression type connector fittings produced by various connector manufactures.

Another example is U.S. Pat. No. 6,708,396 issued Mar. 23, 2004 that discloses a hand-held tool for compressively installing F-connectors on coaxial cable. An elongated body has an end stop and a plunger controlled by a lever arm which forcibly, axially advances the plunger toward and away from the end stop to radially compress a portion of the connector into firm crimping engagement with the end of the coaxial cable.

Similarly, U.S. Pat. No. 6,293,004 issued Sep. 25, 2001 entitled "Lengthwise compliant crimping Tool" includes an elongated body and a lever arm which is pivoted at one end to the body to actuate a plunger having a die portion into which a coaxial cable end can be inserted. When the lever arm is squeezed, resulting axial plunger movements force a preassembled crimping ring on each connector to radially compress each connector into sealed engagement with the cable end, the biasing member will compensate for differences in length of said connectors.

Despite numerous attempts to improve F-connectors, as evidenced in part by the large number of existing patents related to such connectors, a substantial problem with internal sealing still exists. It is important to prevent the entrance of moisture or dust and debris after the connector is installed. To avoid degradation in the direct current signal path established through the installed connector's metal parts, and the radio frequency, VHF, UHF and SHF signal paths and characteristics, a viable seal is required. Connectors are commonly used with coaxial cables of several moderately different outside diameters. For example, common RG-59 or RG-59/U coaxial cable has a different diameter than RG-6 or RG-6/U coaxial cable. Some cables have differently sized outer jackets and other internal differences that may not be readily apparent to the human eye. One way to promote sealing is through internal grommets or seals that are deflected and deformed when the fitting is compressively deployed to tightly encircle the captivated coaxial cable.

For example, U.S. Pat. No. 3,678,446 issued to Siebelist on Jul. 18, 1972 discloses an analogous coaxial connector for coaxial cables which have different sizes and structural details. An internal, coaxial sealing band is utilized for grasping the coaxial cable when the connector parts are secured together. Other examples of connectors or analogous electrical fittings with internal sealing grommets include U.S. Pat. Nos. 3,199,061, 3,375,485, 3,668,612, 3,671,926, 3,846,738, 3,879,102, 3,976,352, 3,986,737, 4,648,684, 5,342,096, 4,698,028, 6,767,248, 6,805,584, 7,118,416, and 7,364,462. Also pertinent are foreign references WO/1999065117, WO/1999065118, WO/2003096484 and WO/2005083845.

The sealing problem associated with compressive F-connectors discussed above, however, remains a difficult problem to overcome and is a focus of this invention. Previously in pending application Ser. No. 12/927,424, entitled "Compression Type Coaxial Cable F-Connectors with Traveling Seal and Barbless Post," filed Nov. 15, 2010, a modified and specially shaped internal sealing grommet was proposed to maximize effective sealing within compression type connectors. Recently it has been discovered that enhanced sealing results unknown to us as of the last mentioned filing date can be achieve by combining a post with a specially grooved shank with the seal of Ser. No. 12/927,424.

BRIEF SUMMARY OF THE INVENTION

This invention provides improved, axial compression type F-connectors designed to be quickly and reliably connected to coaxial cable of varying diameters and structures. The new F-connectors establish a high operating bandwidth and create reliable internal seals.

Each connector has a rigid, metallic hex-headed nut for threadable attachment to conventional threaded sockets. An elongated, body is rotatably and axially coupled to the nut. A rigid, conductive post coaxially extends through the nut and the tubular body, captivating the nut with an internal flange. The elongated, tubular post shank penetrates and received an end of prepared, coaxial cable fitted to the F-connector. A rigid, preferably metallic end cap is slidably fitted to the body, and thereafter forcibly compressed along the length of the body shank for installation. The post is preferably not barbed at its shank insertion end. However, the post shank includes a special groove that enhances sealing with the below described grommet.

A special "traveling seal" is established. To accommodate cables of different sizes and types and diameters, a special sealing grommet is disposed within the connector, preferably seated within the end cap. The enhanced sealing grommet, resembling an O-ring, comprises two primary portions that are integral and coaxial. The outermost portion (i.e., the outer diameter) of the preferred seal is of a generally rectangular cross section, adapted to snugly, coaxially seat within the end cap rear. An integral, inner nose portion of the grommet projects inwardly towards the fitting front. The leading edge of the bulbous nose portion is convex. When an F-connector is compressed about a prepared coaxial cable end, the grommet is deflected and deformed.

During installation, a travelling phenomena occurs wherein the grommet is deformed radially and axially, such that the body is squeezed into the interior annulus proximate the post.

Portions of the grommet are forced longitudinally into contact with the coaxial cable sheath, being compressed into interstitial regions of the wire mesh comprising the cable sheath. Seal deformation is facilitated by the barbless construction of the post., and by the groove formed in the post shank. The deformed grommet thus provides a seal against moisture, dust, debris and the elements.

Thus a basic object is to provide an improved, compression type electrical connector suitable for satellite and cable television systems, that generates an improved seal when the fitting is installed.

Another basic object is to provide an improved compression-type F-connector that can be reliably used with a variety of different installation tools and with a variety of different cables.

It is also an object to provide a compression type F-connector of the character described that facilitates a proper "capture" by various compression installation tools.

Another important object is to provide a compression type F-connector of the type disclosed that reliably provides a good electrical connection path between the threaded nut, the internal post, and the coaxial cable to which the connector is fitted.

A still further object is to provide a connector suitable for use with demanding large, bandwidth systems approximating four GHz. It is a feature of our invention that a grooved post is preferably utilized, and bandwidth is enhanced by eliminating resonant cavities.

A related object is to provide an F-connector ideally adapted for home satellite systems distributing multiple high definition television channels.

Another important object is the F-connector has been adapted for use in wideband RF applications.

Another important object is to provide a connector of the character described that includes an improved sealing grommet for enhancing the required weatherproof and moisture resistant characteristics of the fitting.

A related object of the invention is to encourage the formation of a reliable seal by modifying post structure to cooperate with the sealing grommet.

Another important object is to provide a compression F-connector of the character described that can be safely and properly installed without deformation of critical parts during final compression.

A related object is to provide a connector of the character described that reliably functions even when exposed to asymmetric compression forces.

Another important object is to provide an electrical connector of the character described which provides a reliable seal even when used with coaxial cables of different diameters and physical characteristics and sizes.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

For purposes of disclosure the entire disclosure within U.S. utility patent application entitled "Compression Type Coaxial Cable F-Connectors with Traveling Seal and Barbless Post," filed Nov. 15, 2010, Ser. No. 12/927,424, and U.S. Pat. Nos. 7,841,896 and 7,513,795 are hereby incorporated by reference as if fully set forth herein.

Figure 7:
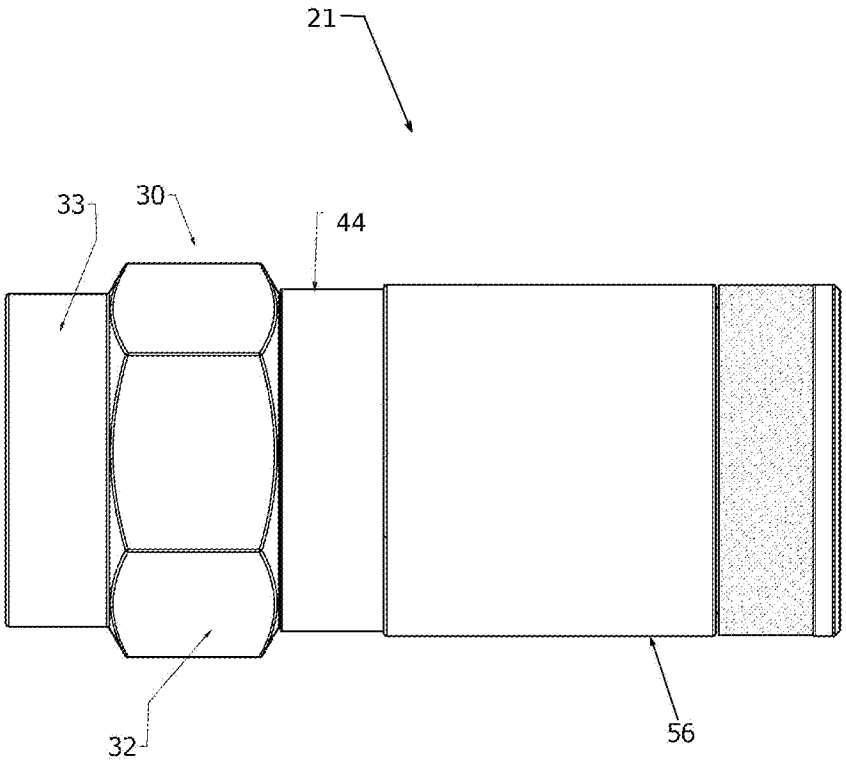
FIG. 7 is a longitudinal top plan view of the closed connector of FIG. 6, the bottom view substantially comprising a mirror image.
Figure 8:
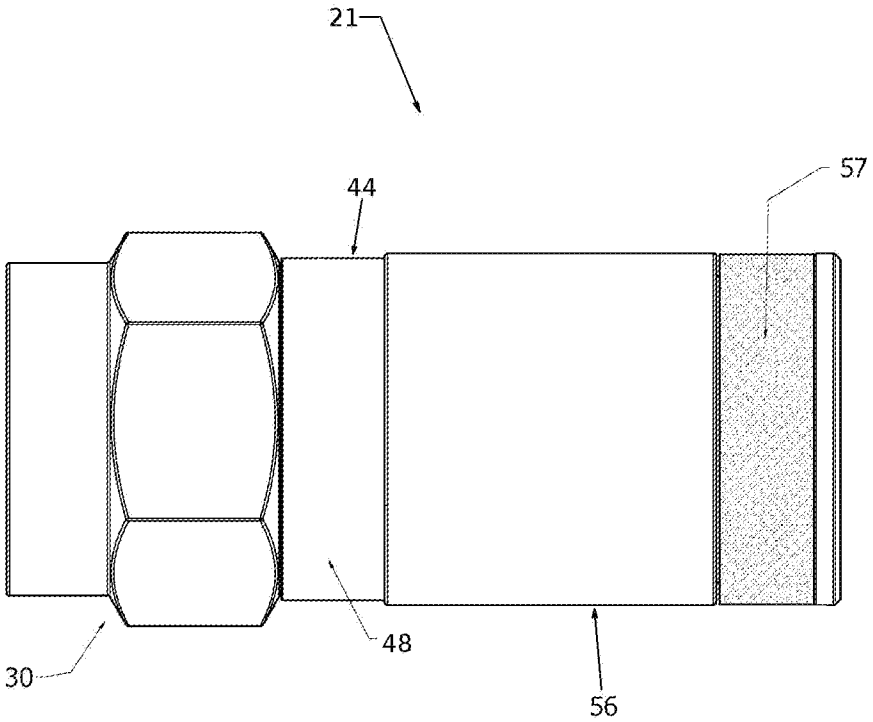
FIG. 8 is a longitudinal side elevational view of the closed connector of FIGS. 6 and 7, the opposite side view substantially comprising a mirror image.

With initial reference directed to FIGS. 1-5 of the appended drawings, an open F-connector for coaxial cable constructed generally in accordance with the preferred embodiment of the invention has been generally designated by the reference numeral 20. The same connector disposed in a closed position is designated 21 (i.e., FIGS. 6-8). Connectors 20 and 21 are adapted to terminate an end of properly prepared coaxial cable, the proper preparation of which is well recognized by installers and others with skill in the art. After a prepared end of coaxial cable is properly inserted through the open bottom end 26 (FIG. 1) of an open connector 20, the connector is placed within a suitable compression hand tool for compression, substantially assuming the closed configuration of FIG. 6.

Figure 11:
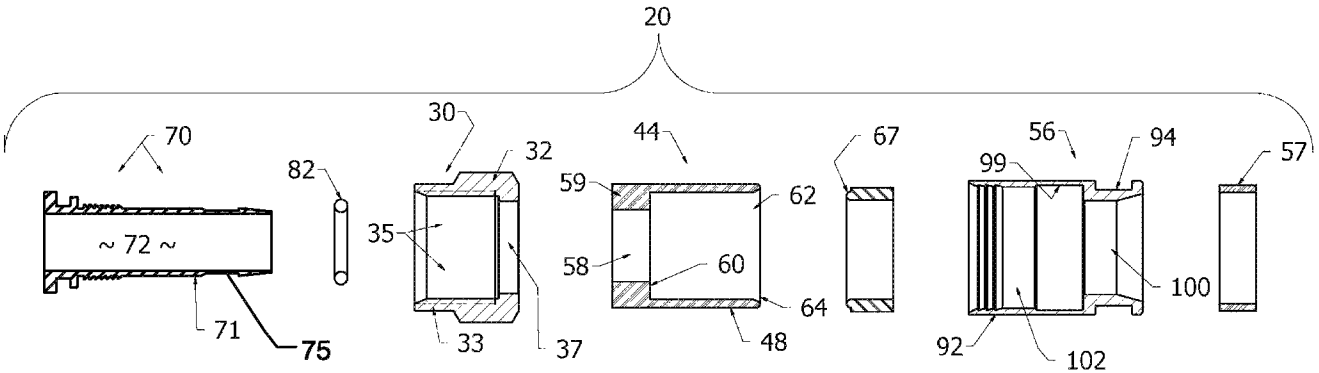
FIG. 11 is an exploded, longitudinal sectional view of the preferred connector.
Figure 13:
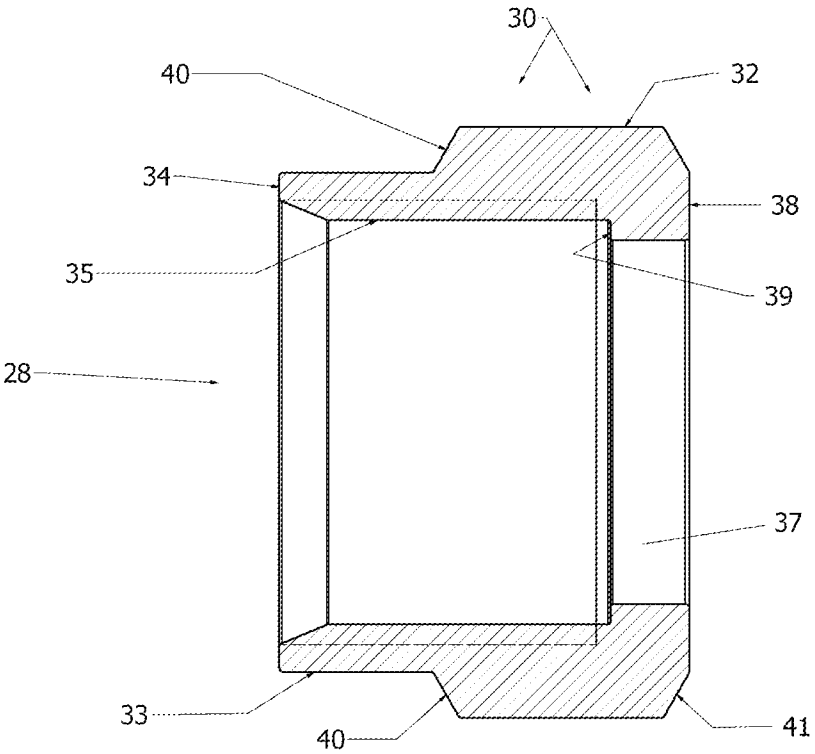
FIG. 13 is an enlarged, longitudinal sectional view of the preferred hex head.

With additional reference directed to FIGS. 11 and 13, the preferred rigid, tubular, metallic nut 30 has a conventional faceted, preferably hexagonal drive head 32 integral with a protruding, coaxial stem 33. Conventional, internal threads 35 are defined in the nut or head interior for rotatable, threadable mating attachment to a suitably-threaded socket. The open front mouth 28 of the connector (i.e., FIGS. 1, 13) appears at the front of stem 33 surrounded by annular front face 34 (FIG. 13). A circular passageway 37 is concentrically defined in the faceted drive head 32 at the rear of nut 30. Passageway 37 is externally, coaxially bounded by the outer, round peripheral wall 38 forming a flat, circular end of the connector nut 30. An inner, annular shoulder 39 on the inside of head 32 is spaced apart from and parallel with outer wall 38 (FIG. 13). A leading external, annular chamfer 40 and a spaced apart, rear external, annular chamfer 41 defined on hex head 32 are preferred for ease of handling.

An elongated, tubular body 44 (FIGS. 11, 14) formed from plastic or metal, is mounted adjacent nut 30. Body 44 preferably comprises a shank 48 sized to fit as illustrated in FIG. 11. The elongated, outer peripheral surface 52 (FIG. 14) of shank 48 is smooth and cylindrical. The nut 30 rotates relative to the post and body and compression member.

In assembly, the end cap 56 is pressed unto body 44, coaxially engaging the shank 48. The end cap 56 discussed hereinafter (i.e., FIGS. 11, 15) will smoothly, frictionally grip body 44 along and upon any point upon body shank 48. In other words, when the end cap 56 is compressed unto the body of either connector 20, 21, the connector 20, 21 assumes a closed position (i.e., FIG. 6).

The body 44 is hollow. Body 44 has an internal, coaxial passageway 58 extending from the annular front face 59 defined at the body front (i.e., FIG. 14) to an inner, annular wall 60 that coaxially borders another passageway 62, which has a larger diameter than passageway 58. The elongated passageway 62 is coaxially defined inside shank 48 and extends to annular rear, surface 63 (FIG. 14) coaxially located at the rear end 64 of the shank 48. As best viewed in cross section as in FIG. 14, the annular rear surface 63 of body 44 is tapered proximate rear end 64 which generates a wedging action when the annular leading rear surface 65 contacts the grommet 67 when the connector 20 is compressed.

For moisture sealing, it is preferred that sealing grommet 67 be employed (FIG. 11). The enhanced sealing grommet 67 is coaxially disposed within end cap 56 as explained in detail hereinafter. Grommet 67 is preferably made of a silicone elastomer.

Figure 12:
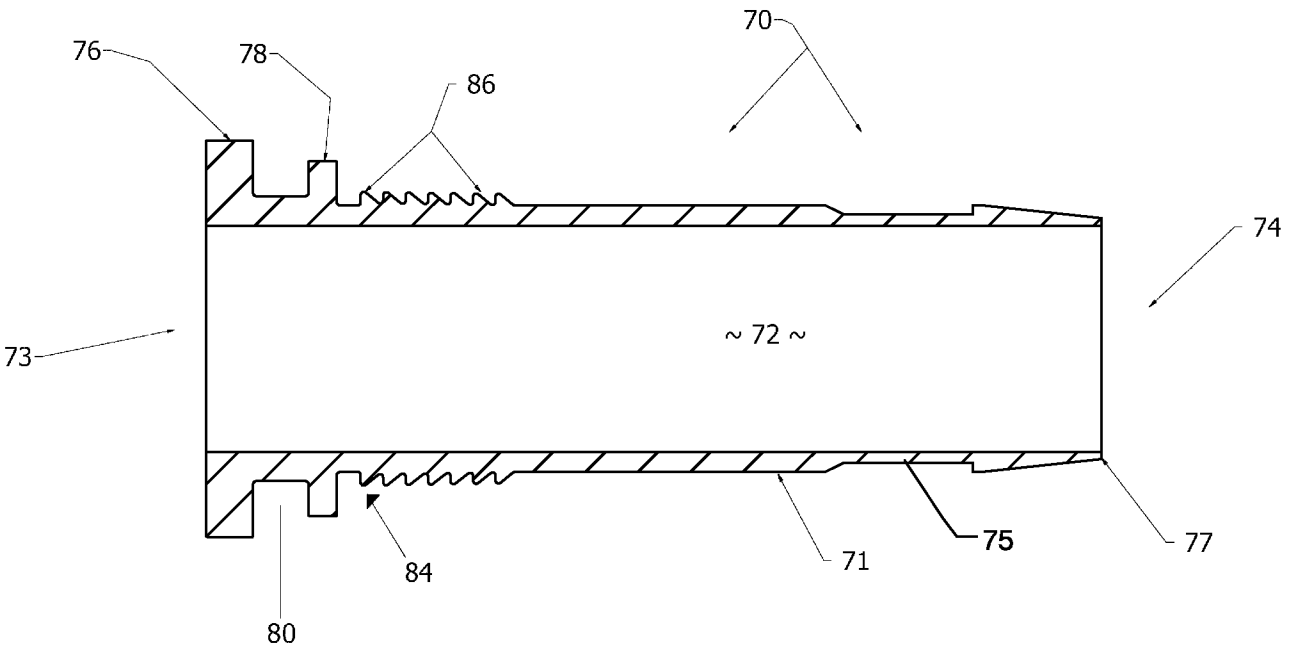
FIG. 12 is an enlarged, longitudinal sectional view of the preferred grooved barbless post.
Figure 17:
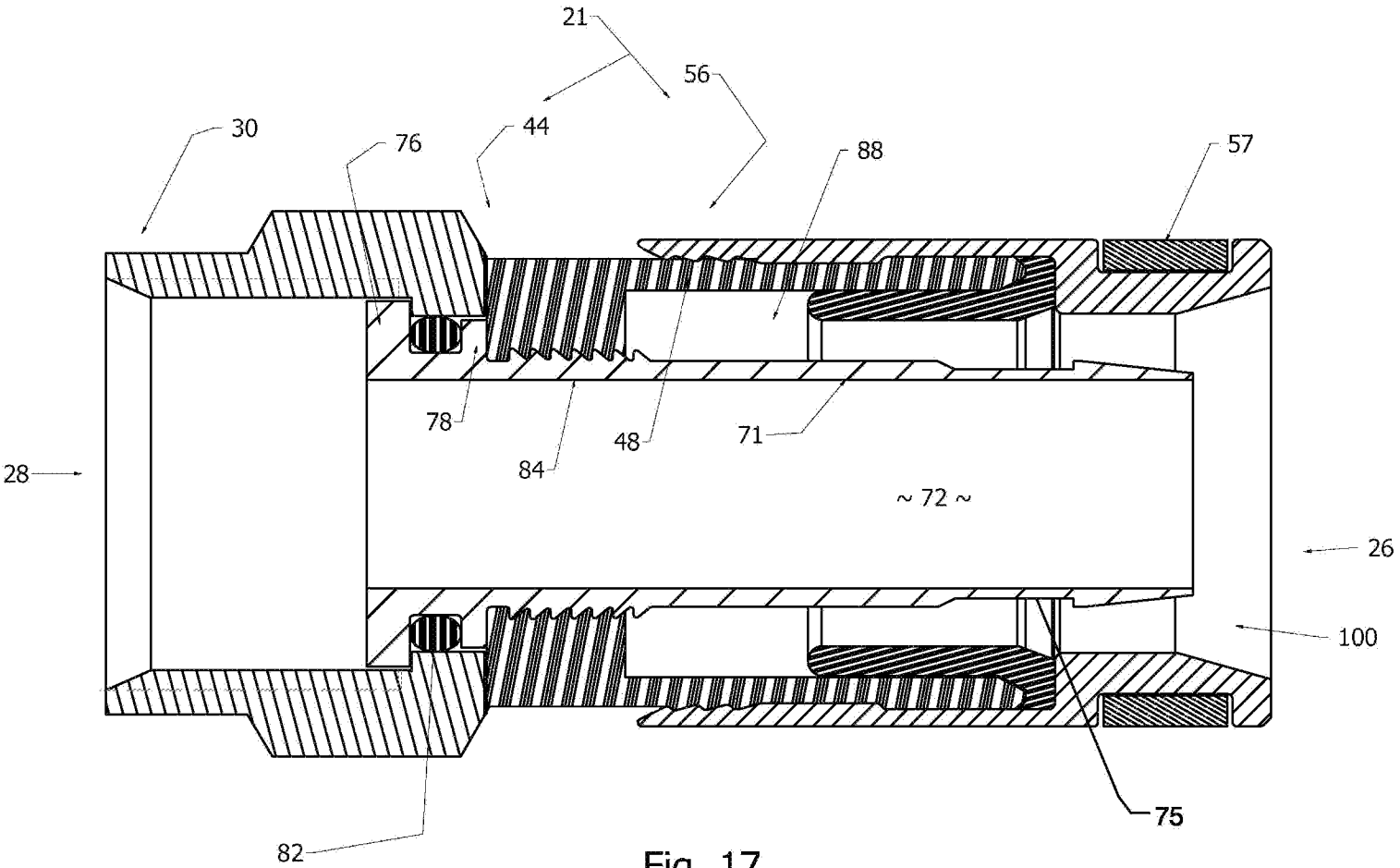
FIG. 17 is a longitudinal sectional view similar to FIG. 16, showing the connector in the "closed" or compressed position, with no coaxial cable inserted.

With primary reference directed now to FIGS. 11 and 12, the post 70 rotatably, mechanically couples the hex headed nut 30 to the body 44. The metallic post 70 also establishes electrical contact between the braid of the coaxial cable (i.e., FIGS. 18, 19) and the nut 30. The tubular post 70 defines an elongated shank 71 with a coaxial, internal passageway 72 extending between its front 73 and rear 74 (FIG. 12). A front, annular flange 76 is spaced apart from an integral, reduced diameter flange 78, across a ring groove 80. A conventional, resilient O-ring 82 (FIG. 11) is preferably seated within ring groove 80 when the connector is assembled. A post collar region 86, preferably lacking serrations of the type disclosed in our prior applications, is press fitted into the body 44, frictionally seating within passageway 58 (i.e., FIG. 11). When a plastic body is used, serrations on post collar region 86 are preferred to improve frictionally seating within passageway 58. In assembly it is also noted that post flange 76 (i.e., FIG. 12) axially contacts inner shoulder 39 (FIG. 13) of nut 30 Inner post flange 78 axially abuts front face 59 (FIG. 14) of body 44 with post 70 penetrating passageway 58. The sealing O-ring 82 is circumferentially frictionally constrained within nut 30 coaxially inside passageway 37 (FIGS. 11, 17).

Figure 14:
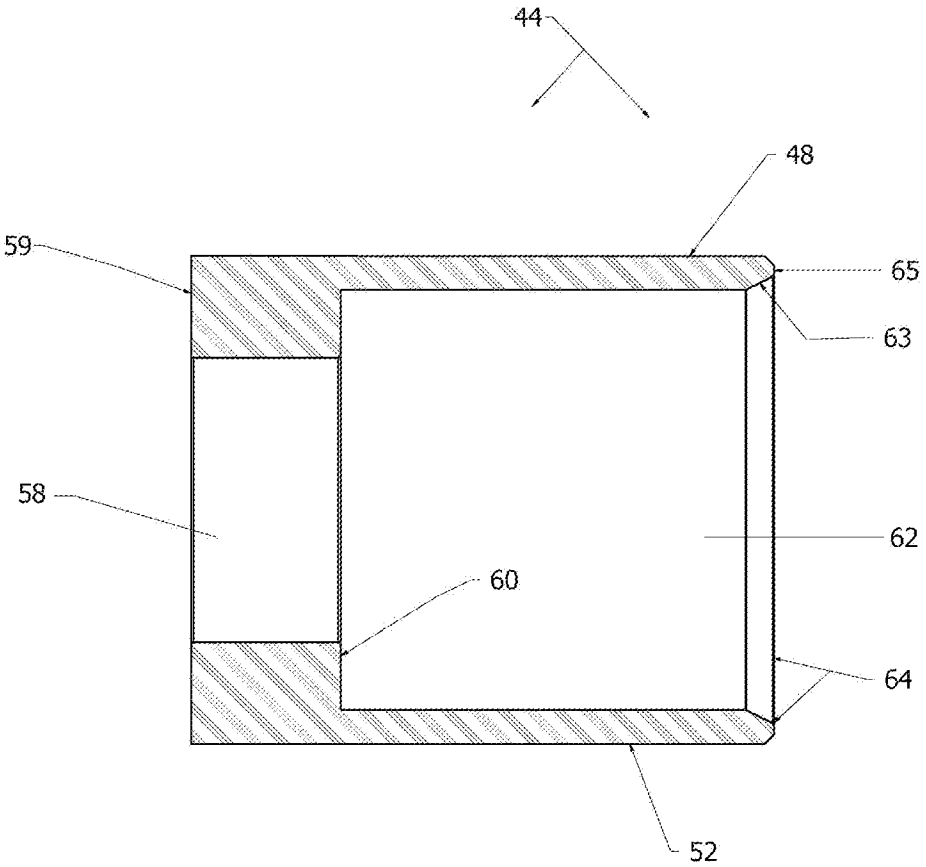
FIG. 14 is an enlarged, longitudinal sectional view of the preferred connector body.

It will be noted that the post shank 71 is substantially tubular, with a smooth, outer shank surface extending to a coaxial groove 75 that borders slightly chamfered, tapered end 77. The shank end 77 penetrates the coaxial cable prepared end, such that the inner, insulated conductor penetrates post shank passageway 72 and coaxially enters the mouth 28 in nut 30. Also, the braided shield of the coaxial cable is coaxially positioned around the exterior of post shank 71, within annulus 88 (FIG. 17) coaxially formed within body passageway 62 (FIG. 14) between post 70 and the shank 48 of body 44 (FIGS. 11, 14). In the preferred embodiment coaxial groove 75 is a single groove that is fifty percent of the length 134 of grommet 67 (FIG. FIG. 22). In alternative embodiments coaxial groove 75 may consist of two or more grooves, and may be from five percent to ninety percent of length 134 of grommet 67.

Figure 1:
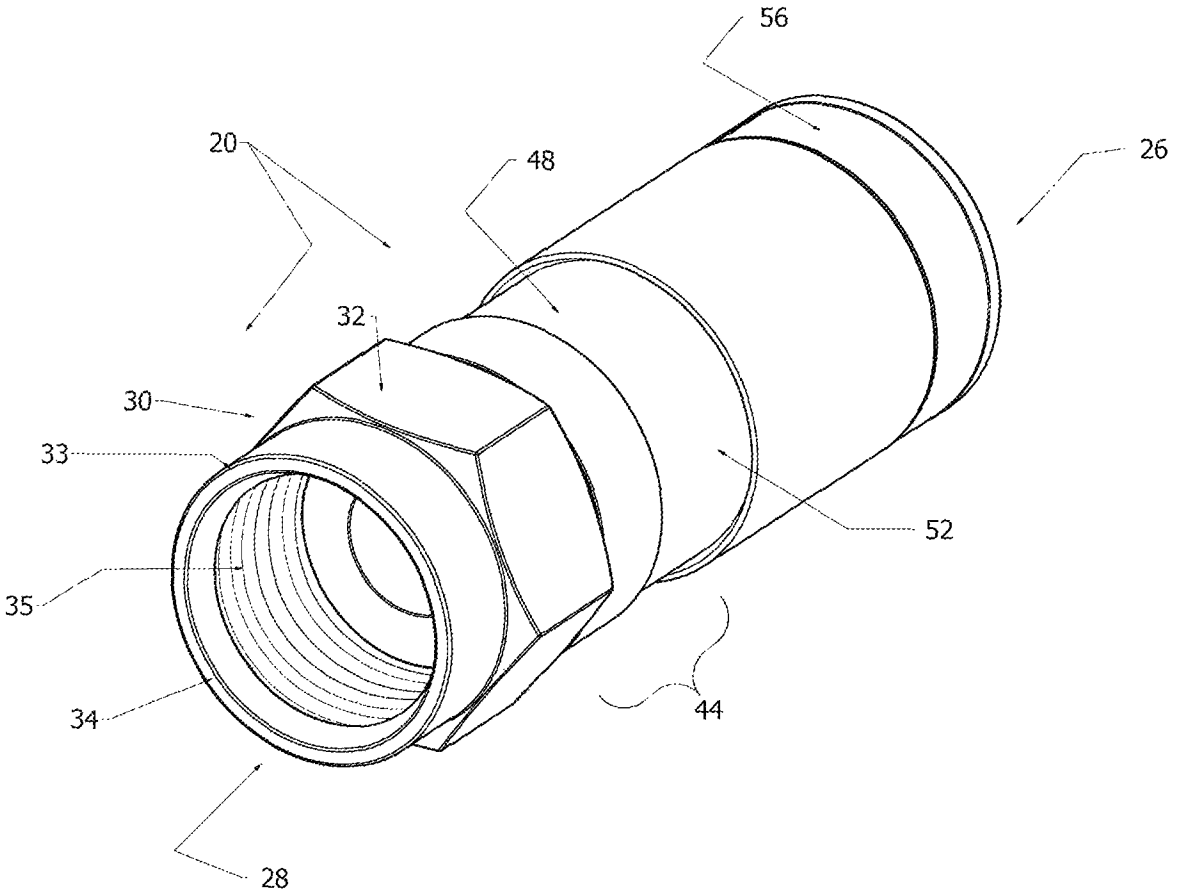
FIG. 1 is a longitudinal isometric view of the preferred connector, showing it in an uncompressed preassembly or "open" position.
Figure 2:
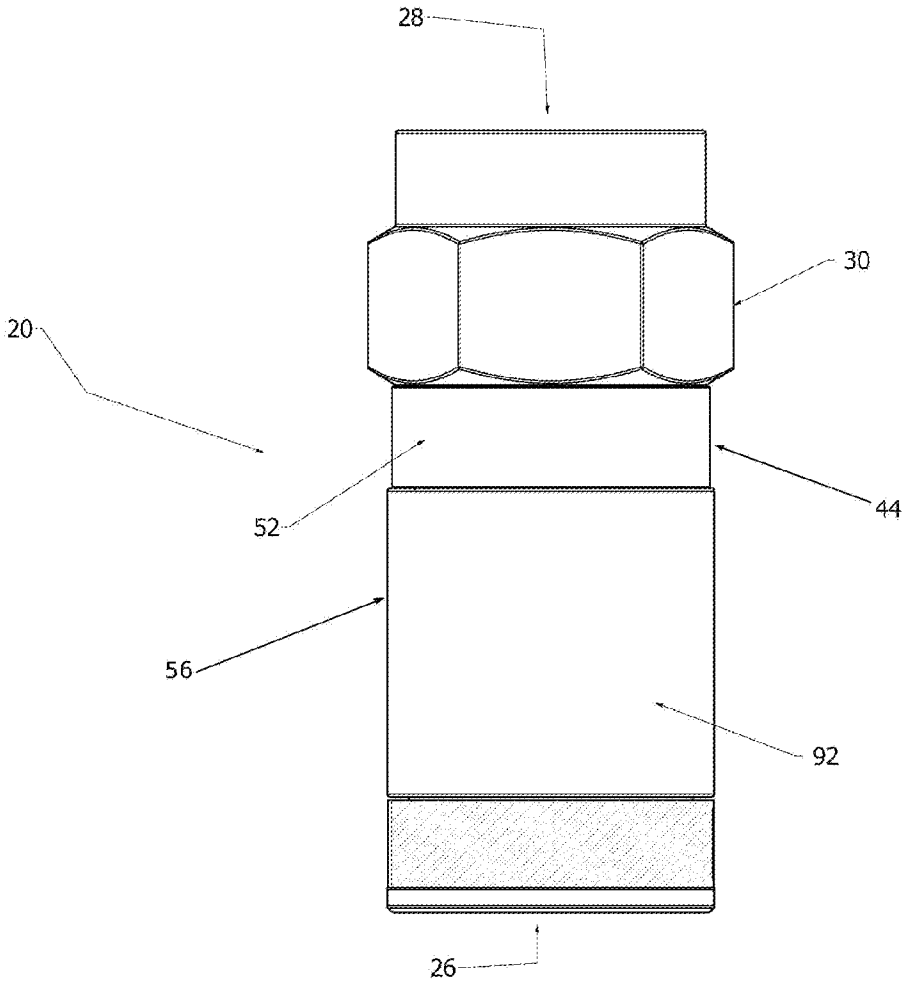
FIG. 2 is a longitudinal top plan view of the connector of FIG. 1, the bottom view substantially comprising a mirror image.
Figure 3:
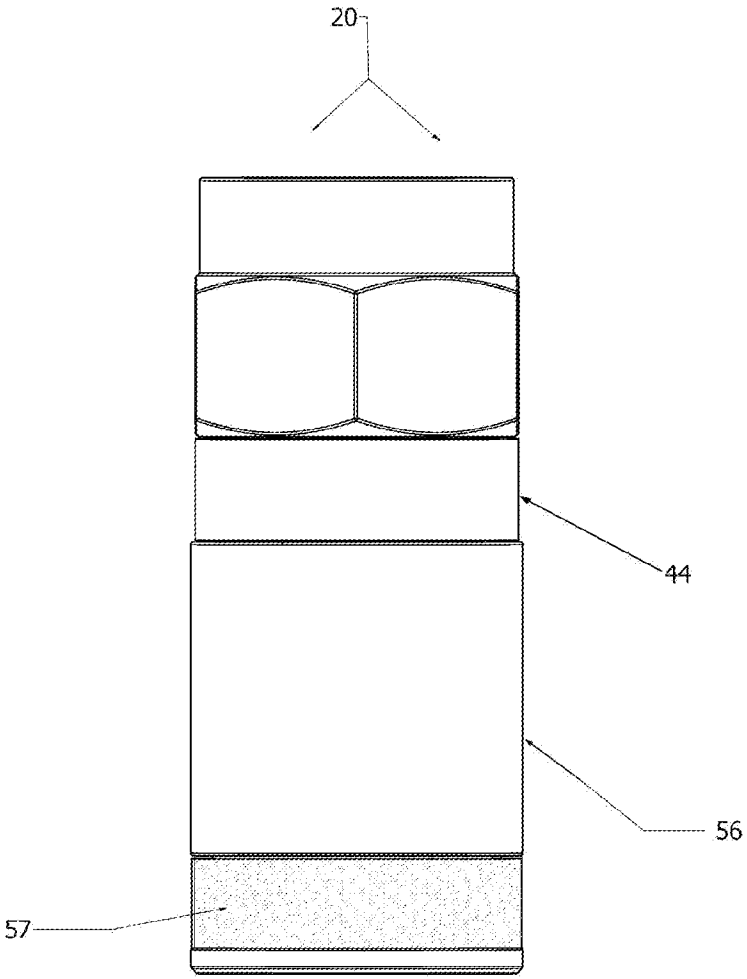
FIG. 3 is a longitudinal side elevational view of the connector of FIGS. 1 and 2, the opposite side view substantially comprising a mirror image.
Figure 4:
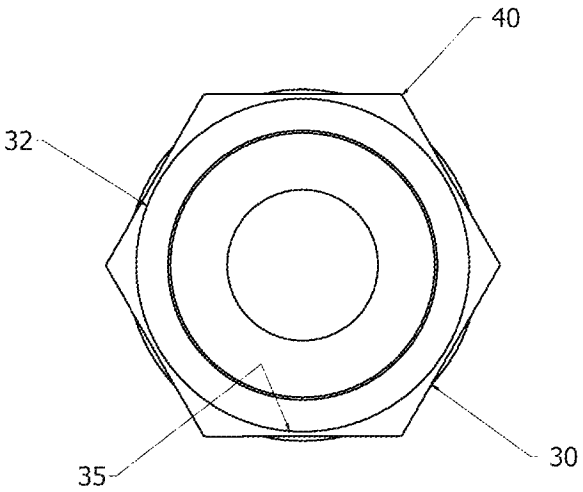
FIG. 4 is a front end view, taken from a position generally above FIG. 2 and looking down.
Figure 5:
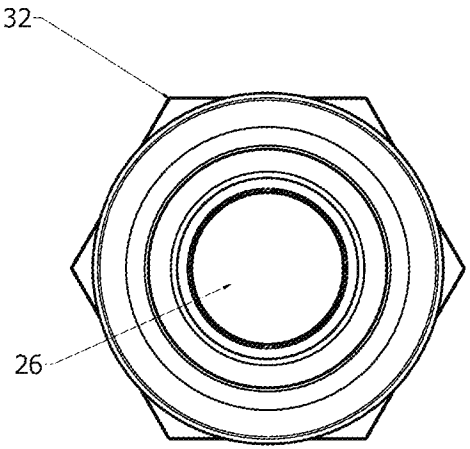
FIG. 5 is a rear end view, taken from a position generally below FIG. 2 and looking up.
Figure 6:
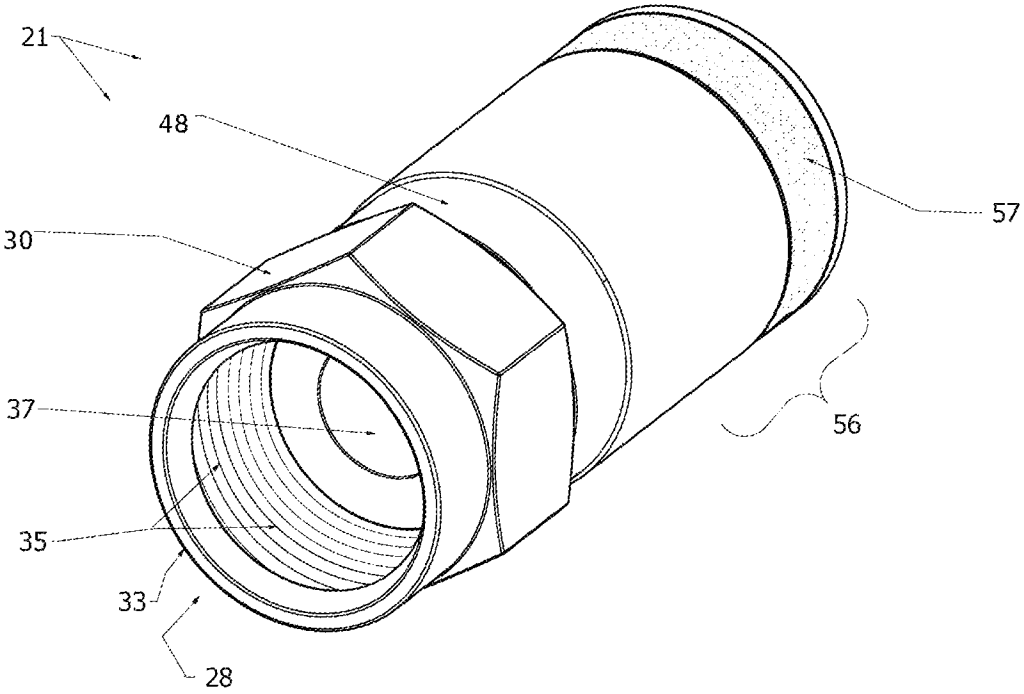
FIG. 6 is a longitudinal isometric view of the preferred connector similar to FIG. 1, but showing it in a compressed, "closed " position assumed after compression.
Figure 9:
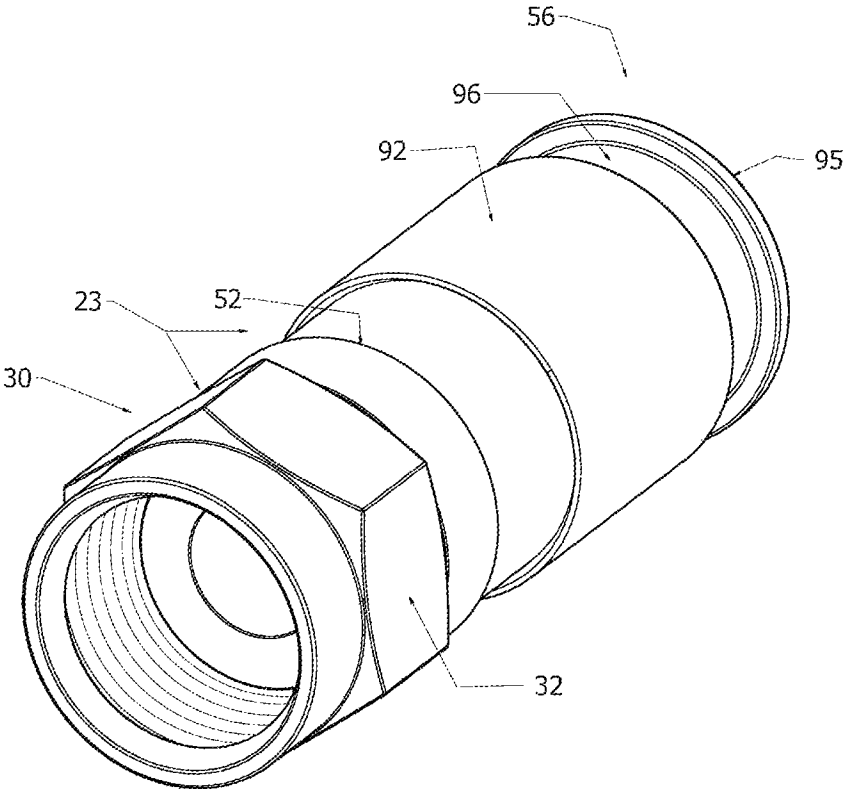
FIG. 9 is a longitudinal isometric view of an alternative preferred connector, showing it in an uncompressed preassembly or "open" position.
Figure 10:
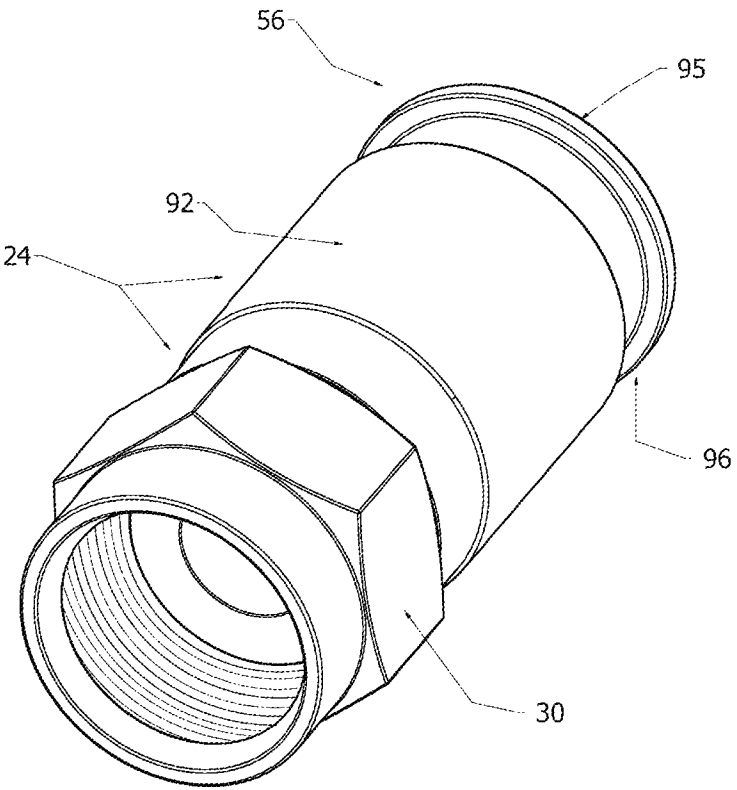
FIG. 10 is a longitudinal isometric view of the alternative connector of FIG. 9, showing it in a compressed or "closed " position.
Figure 15:
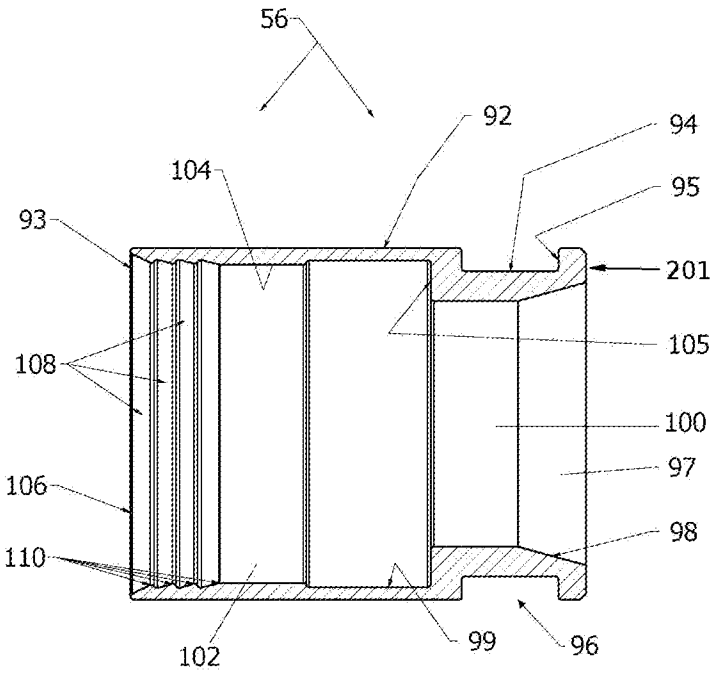
FIG. 15 is an enlarged, longitudinal sectional view of the preferred end cap.

The preferred end cap 56 is best illustrated in FIGS. 11 and 15. The rigid, preferably metallic end cap 56 comprises a tubular body 92 that is integral and concentric with a rear neck 94 of reduced diameter. The neck 94 terminates in an outer, annular flange 95 forming the end cap rear and defining a coaxial cable input hole 97 with a beveled peripheral edge 98. With all connector embodiments 20, 21 (FIGS. 2, 6) and 23, 24 (FIGS. 9, 10), an external, annular ring groove 96 is concentrically defined about neck 94 (FIG. 15). The ring groove 96 is axially located between body 92 and flange 95. The front of the end cap 56, and the front of body 92 (FIG. 15) is defined by concentric, annular face 93. The external ring groove 96 is readily perceptible by touch. However, it is preferred that resilient ring 57 (FIG. 11) be seated within groove 96 in connectors 20, 21 as seen in FIGS. 3 and 6. Internal ring groove 99 (FIG. 15) seats the preferred sealing grommet 67 (FIG. 11).

Figure 21B:
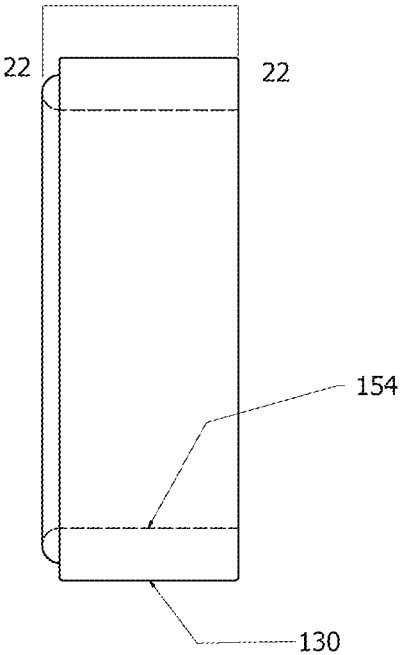
FIG. 21B is an enlarged elevational view of the preferred sealing grommet.
Figure 21A:
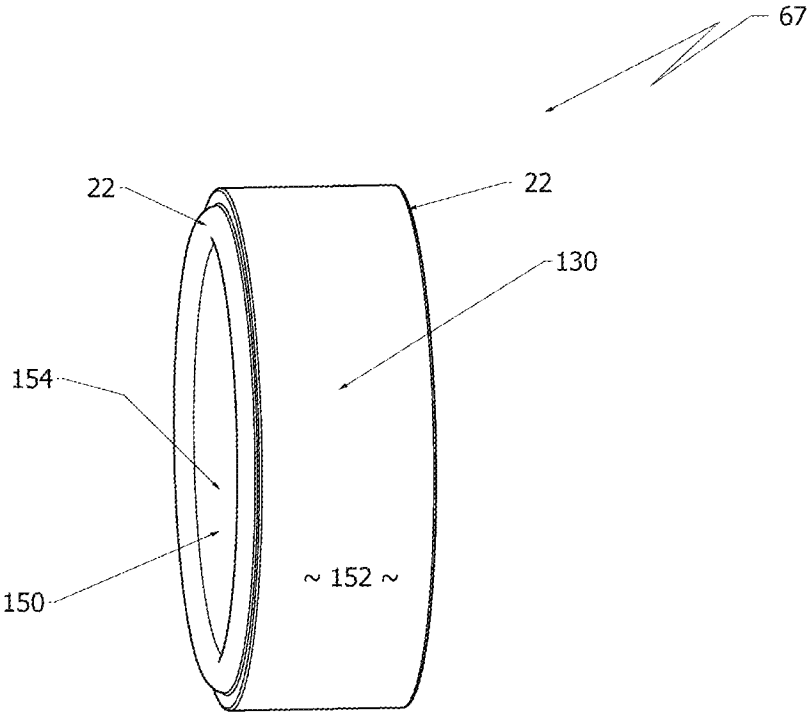
FIG. 21A is an enlarged isometric view of the preferred sealing grommet.

Hole 97 at the rear of end cap 56 (FIG. 15) communicates with cylindrical passageway 100 concentrically located within neck 94. Passageway 100 leads to a larger diameter passageway 102 defined within end cap body 92. Ring groove 99 is disposed between passageways 100 and 102. Passageway 102 is sized to frictionally, coaxially fit over shank 48 of connector body 44 in assembly. There is an inner, annular wall 105 concentrically defined about neck 94 and facing within large passageway 102 within body 92 that is a boundary between end cap body 92 and end cap neck 94. Grommet 67 (i.e., FIGS. 11, 21) bears against wall 105 in operation. Once a prepared end of coaxial cable is pushed through passageways 100, and 102 it will expand slightly in diameter as it is axially penetrated by post 70.

The deformed grommet 67 (i.e. FIG. 22) whose axial travel is resisted by internal wall 105 (FIG. 15) will be deformed and reshaped, "travelling" to the rest position assumed when compression is completed, as discussed below. After fitting compression, subsequent withdrawal of coaxial cable from the connector will be resisted in part by surface tension and pressure generated between the post shank and contact with the coaxial cable portions within it and coaxially about it.

The smooth, concentric outer surface of the connector body's shank 48 (i.e., FIGS. 11, 14) fits snugly within end cap passageway 102 when the end cap 56 is telescopingly, slidably fitted to the connector body 44. Cap 56 may be firmly pushed unto the connector body 44 and then axially forced a minimal, selectable distance to semi-permanently retain the end cap 56 in place on the body (i.e., coaxially frictionally attached to shank 48). There is no critical detented position that must be assumed by the end cap. The inner smooth cylindrical surface 104 of the end cap 56 is defined concentrically within body 92 (FIG. 15). Surface 104 coaxially, slidably mates with the smooth, external cylindrical surface 52 (FIG. 14) of the body shank 48. Thus the end cap 56 may be partially, telescopingly attached to the body 44, and once coaxial cable is inserted as explained below, end cap 56 may be compressed unto the body, over shank 48, until the coaxial cable end is firmly grasped and the parts are locked together. It is preferred however that the open mouth 106 at the end cap front have a plurality of concentric, spaced apart beveled rings 108 providing the end cap interior surface 104 with peripheral ridges resembling "teeth" 110 that firmly grasp the body shank 48 (i.e., FIGS. 11, 14). Preferably there are three such "teeth" 110 (FIG. 15). However, since the cap is metal, it will function without teeth 110.

When the end cap 56 is compressed to the body 44, it can firmly grasp the shank 48 and make a firm connection without radially compressing the connector body, which is not deformed in assembly. The end cap 56 may be compressed to virtually any position along the length of body shank 48 between a position just clearing annular surface 65 (i.e., FIG. 18) and the maximum deflection of the end cap 56 (i.e., FIG. 20.) Maximum deflection of the end cap is preferably achieved by a compression tool capable of compressing the connector 21 to a fixed length as is common in the art. Preferably the deflection distance between the front 73 of the post 70 and the rear 201 of end cap 56 is 21 mm. When the fitting is compressed during the compression cycle, the beveled surface 63 of body shank 48 at shank end 64 (i.e., FIG. 14) will compressively engage and deform the grommet 67, as in FIG. 20, sealing the coaxial cable coaxially captivated within the compressed connector. However, the grommet configuration illustrated in the fully compressed position of FIG. 20 occurs or results only after the "traveling " effects as the connector transitions between the position seen in FIG. 18, the intermediate compressed position of FIG. 19, and the compressed portion of FIG. 20.

Figure 16:
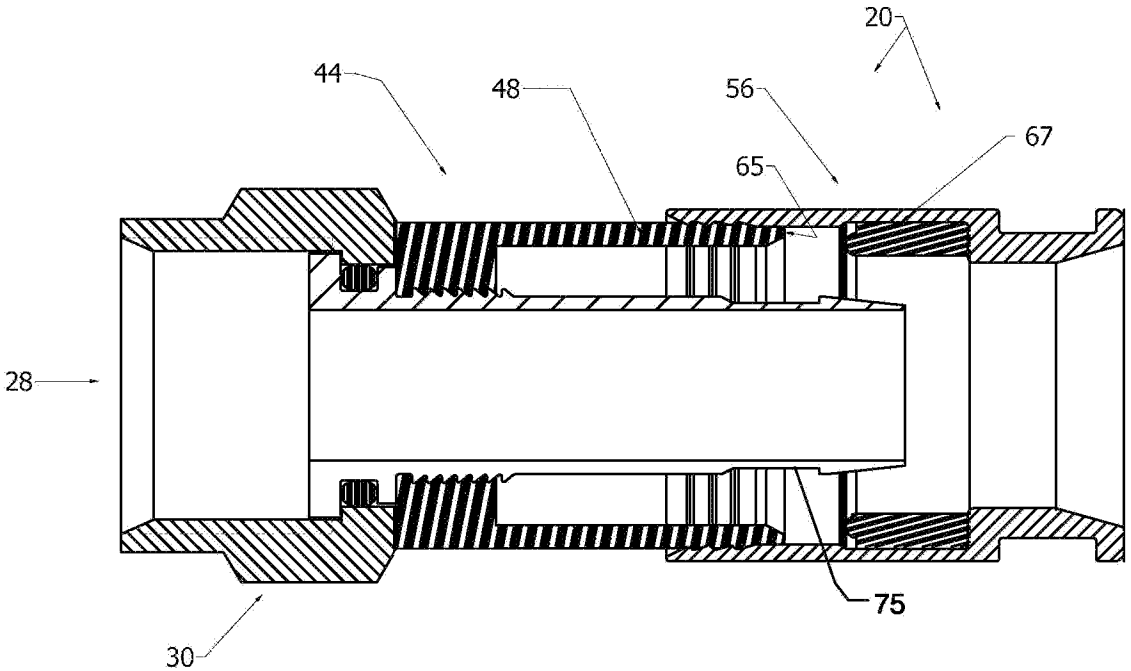
FIG. 16 is an enlarged, longitudinal sectional view of the preferred connector, shown in an uncompressed position, with no coaxial cable inserted.

In FIG. 16 it can be seen that when the end cap 56 is first coupled to the shank 48 of body 44, the shank end 64 (and annular surface 65) are axially spaced apart from the grommet 67 that is coaxially positioned within the rear interior of the end cap 56. However, when the connector 20 is compressed during installation, the shank rear end 64 is forced into and against the grommet 67, which deforms as illustrated by comparing FIGS. 18-20. The mass of the grommet 67 is radially and concentrically directed towards the coaxial cable to seal it.

Figure 18:
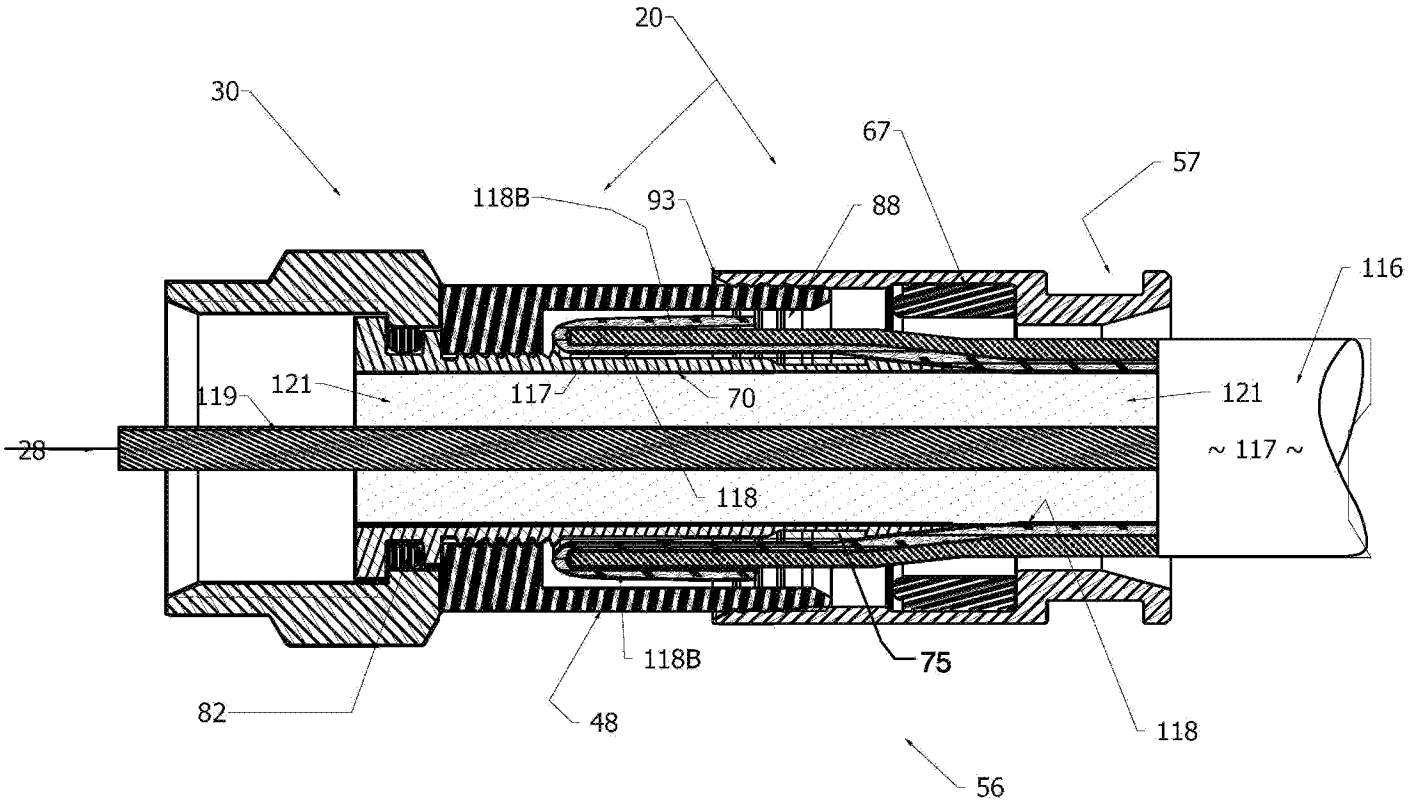
FIG. 18 is a view similar to FIG. 16, showing the connector in an open position, with a prepared end of coaxial cable inserted.
Figure 19:
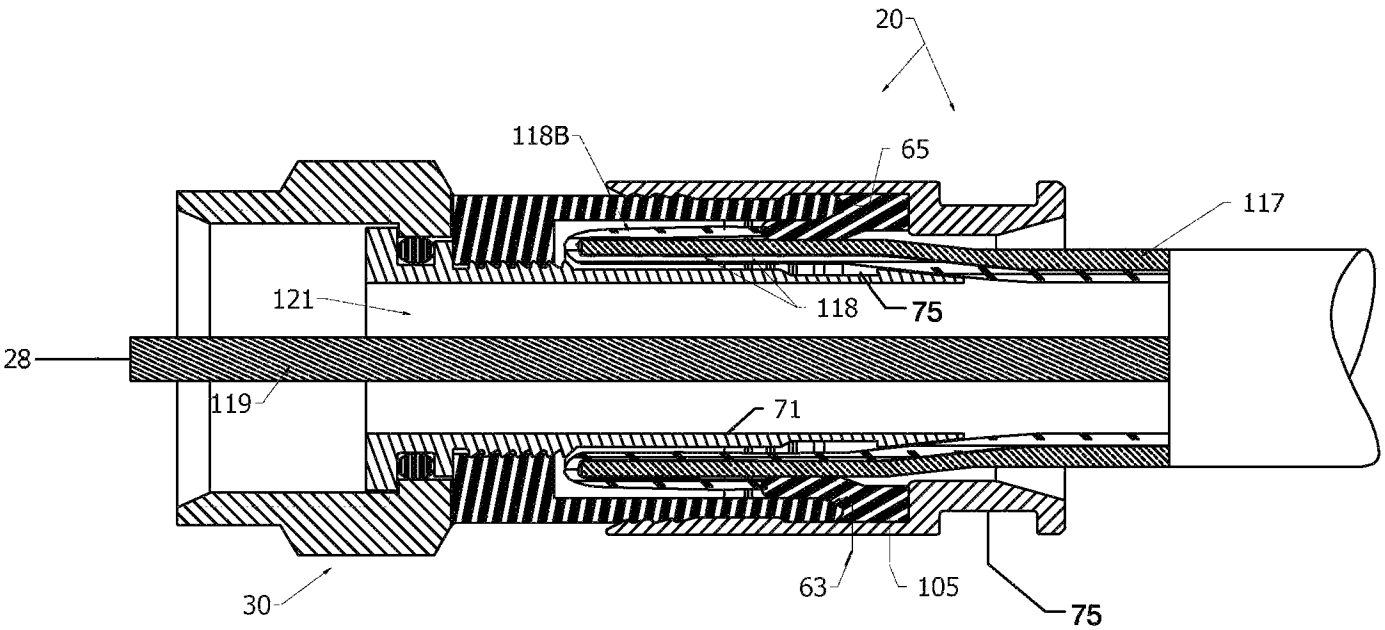
FIG. 19 is a view similar to FIG. 18, showing the connector in a partially compressed position.
Figure 20:
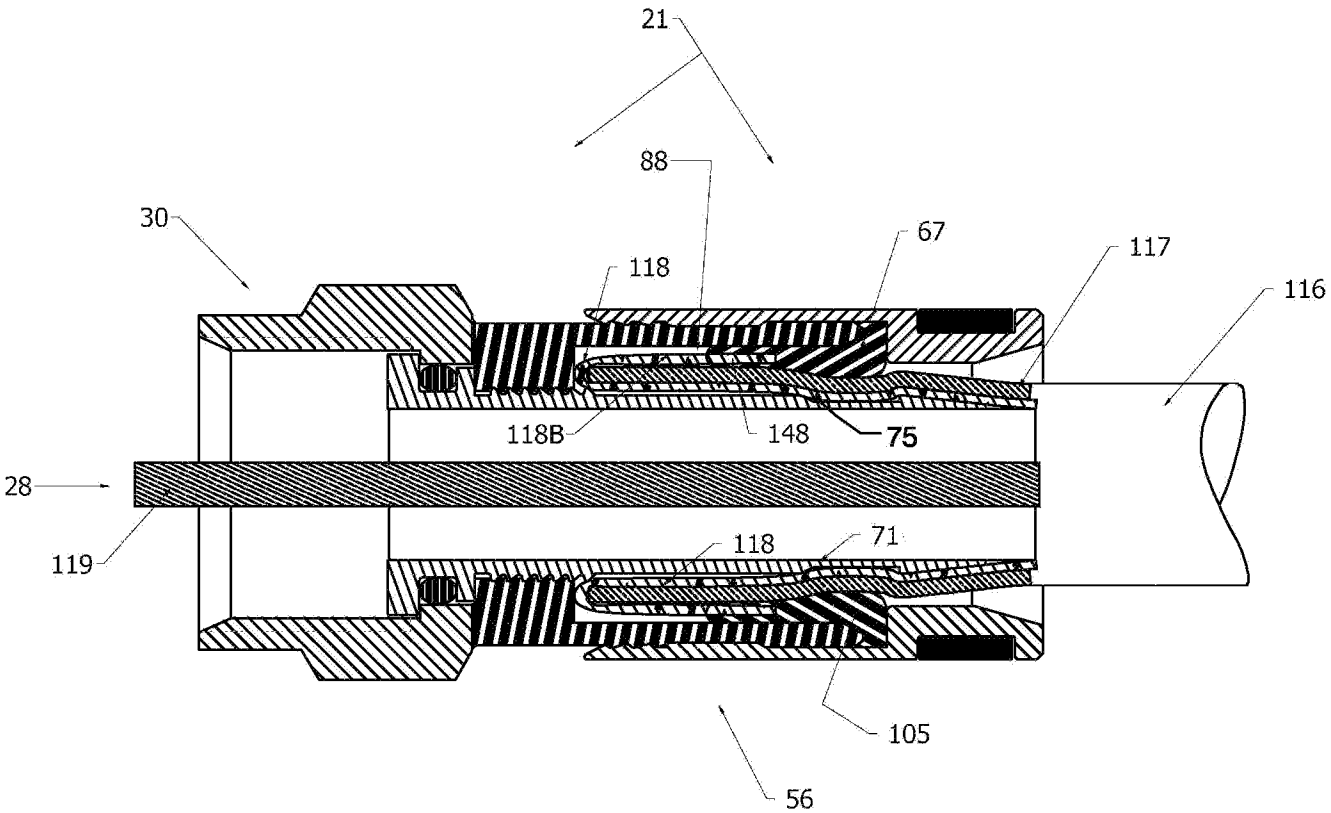
FIG. 20 is a view similar to FIGS. 18 and 19, showing the connector in a closed, fully compressed position, captivating the coaxial cable.

In FIGS. 18-20 a prepared end of coaxial cable 116 is illustrated within the connector. The coaxial cable 116 has an outermost, usually black-colored, plastic jacket 117 forming a waterproof, protective covering, a concentric braided metal sheath 118, and an inner, copper alloy conductor 119. There is an inner, plastic insulated tubular dielectric portion 121. When the prepared end is first forced through the connector rear, passing through end connector hole 97 (FIG. 15) and through passageways 100, 102, the end cap 56 is uncompressed as in FIG. 18. The coaxial cable prepared end is forced through the annulus 88 between the post 70 and the inner cylindrical surface of shank 48 (FIG. 14) with post 70 coaxially penetrating the coaxial cable between the conductive braid 118 and the dielectric insulation 121, with the latter coaxially disposed within the post. The prepared end of the coaxial cable has its outer metallic braid 118 folded back and looped over insulative outer jacket 117, forming looped back portion 118B (FIG. 18). The metal braid or sheath, as seen in FIGS. 18-20, makes electrical contact with the post 70 and, after full compression, contacts portions of the body.

Dielectric insulation 121 coaxially surrounds the innermost cable conductor 119, and both are coaxially routed through the post. A portion of conductor 119 protrudes from the mouth 28 (i.e., FIG. 18) of the nut 30 on the connector. Thus an end of conductor 119 forms the male portion of the F-connector 20, 21.

As can be seen in FIG. 20 grommet 67 deforms conductive braid 118 and plastic jacket 117 into groove 75 of the post 70. This deformation increases the contact surface area between the post 70 and the conductive braid 118 thereby increasing electrical contact and shielding. The increased contact surface between the grommet 67 and the plastic jacket 117, along with the deformation of the plastic jacket 117 adds to the withdrawal strength necessary to pull the coaxial cable away from the compressed fitting.

Figure 22:
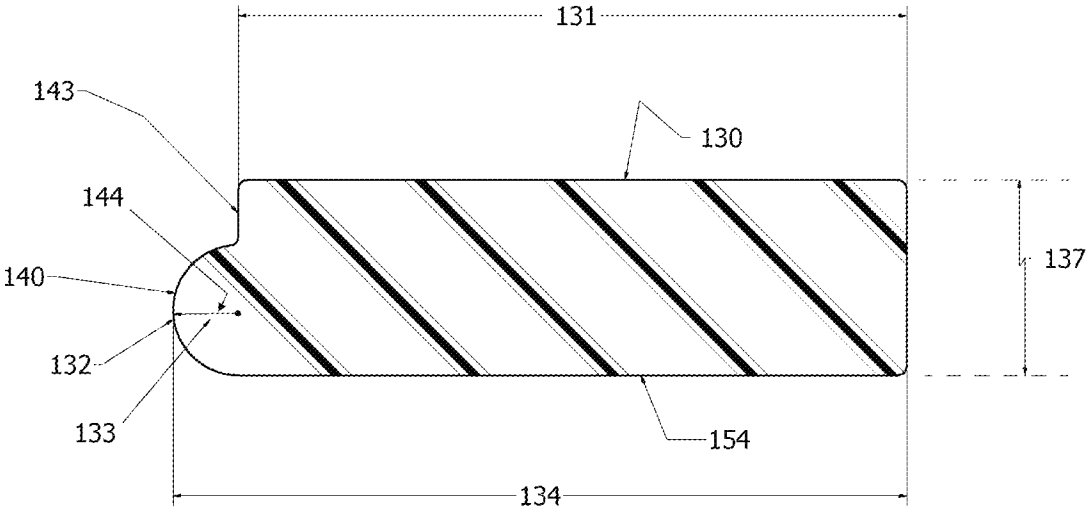
FIG. 22 is an enlarged sectional view of the uncompressed grommet taken generally along lines 22-22 of FIG. 21B.
Figure 23:
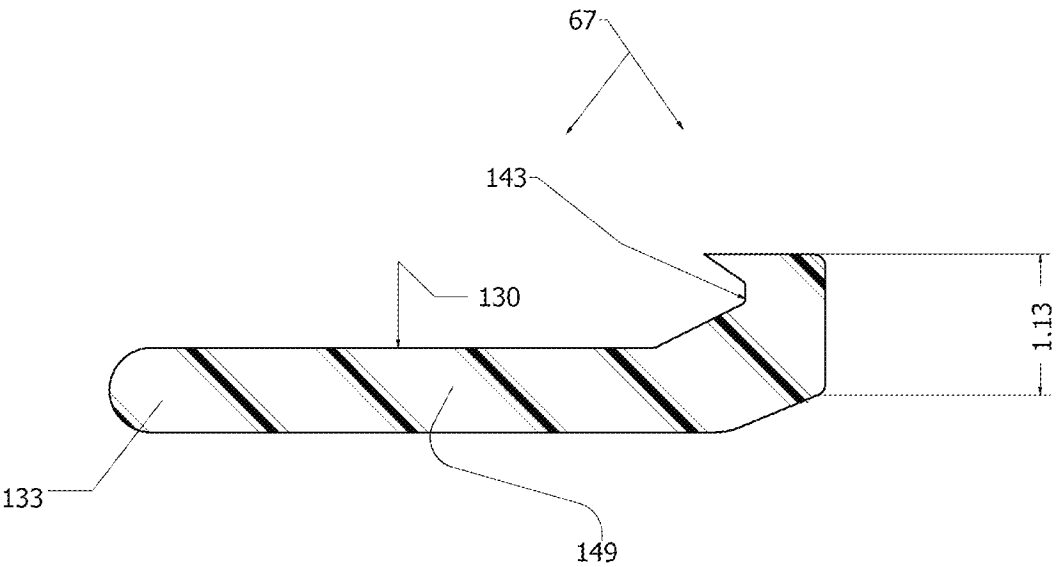
FIG. 23 is an enlarged sectional view of the region of the grommet shown in FIG. 22, showing compression and material travel; and, FIG. 24 is an enlarged plan view taken generally from the left of FIG. 21.
Figure 24:
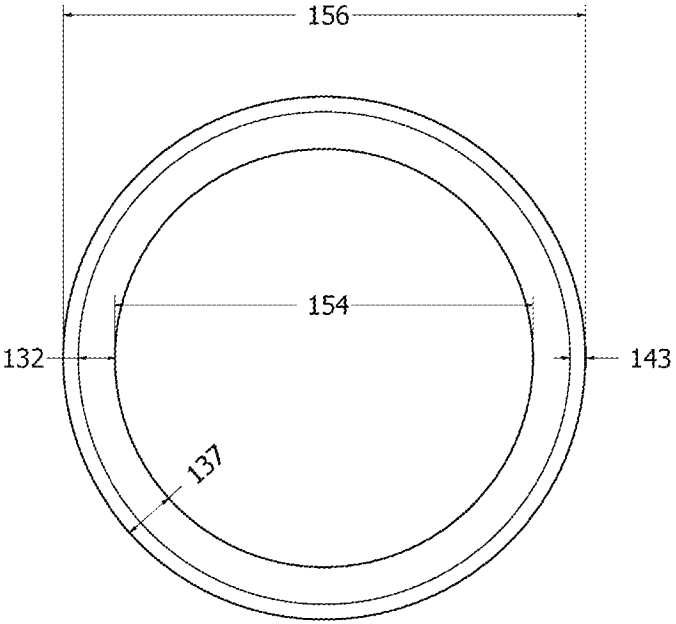

Referring now to FIGS. 21A, 21B, and 22-24, enhanced sealing grommet 67 is generally toroidal. In cross section it is seen that grommet 67 in the preferred embodiment comprises two primary portions that are integral and coaxial. The outermost portion 130 (i.e., the outer diameter) of grommet 67 is of a generally rectangular profile, enabling the grommet 67 to seat within the end cap ring groove 99 discussed earlier. The innermost circumferential surface of the grommet is designated by the reference numeral 150 in FIG. 21A, and the outermost circumferential surface is designated by the reference numeral 152. In FIG. 24 the inner diameter of the grommet 67 is designated by the reference numeral 154, and in the best mode it is 8.4 mm. The larger, outer grommet diameter is designated by the reference numeral 156, and in the preferred embodiment it is 10.5 mm. The ratio between the inner diameter and the outer diameter is preferably 1:1.25.

The grommet length along outer circumference portion 130 is designated by the reference numeral 131 (FIG. 22), and in the preferred embodiment this distance is 3.6 mm. The inner grommet length 134 (i.e. FIG. 22) proximate integral, inner, bulbous grommet portion 132 is longer than length 131. Length 134 is preferably 3.95 mm. Thus, at and along its inner diameter region, grommet 67 is greater in length than at its outer diameter region along length 131 (FIG. 20). The ratio between the smaller length 131 of the uncompressed grommet 67 at its outer diameter region (FIG. 22) and the larger length 134 of the grommet at its inner diameter region is preferably approximately 0.8 to 1.0, or 80-100%. In the preferred embodiment it is 0.9, or 90%.

In FIG. 22 the reference numeral 137 designates the preferred thickness of the grommet 67, which is preferably 0.9 to 1.1 mm. In the preferred embodiment the thickness is 1.05 mm. The ratio between the thickness 137 and length 131 and is preferably between 0.20 and 0.35. In the preferred embodiment the ratio between the thickness 137 and length 131 and is 0.29.

Preferably, bulbous grommet portion 132 comprises a convex nose 133 that, in assembly, points into the interior of the connector towards the nut 30. A slightly inclined neck 143 (FIG. 22) transitions from the curved, outer edge 140 of the bulbous region to the outer diameter, reduced length 131 of the grommet that preferably seats within ring groove 99 (i.e., FIG. 15). The arcuate leading edge 140 of nose 133 has a radius 144, substantially establishing a semicircular geometry. Preferably the length of radius 144 is approximately 8-10% of grommet length 134 (FIG. 22). In the preferred embodiment radius the length of 144 is approximately 9% of grommet length 134 (FIG. 22).

When the connector is compressed, shank 48 of body 44 and end cap 56 are forced together. Prior to compression the grommet 67 is seated proximate rear annular wall 105 in the end cap. The enhanced sealing grommet 67 is squeezed therebetween. Specifically, rear end 64 (FIG. 14) of body shank 48 includes rear leading annular surface 65 that forcibly, contacts grommet 67 at neck 143, and deforms and squeezes the grommet 67. Grommet neck 143 is contacted by and ramped and deformed by contact with tapered surface 63 that generates a ramping and wedging action. When squeezed during installation, the grommet 67 deforms during compression as in FIG. 19 that shows intermediate compression. It can be seen that the grommet body starts to elongate, and a traveling phenomena occurs. The bulbous convex portion 132 deforms and begins to travel horizontally towards the folded-back coaxial cable looped back portion 118B (FIG. 19). A portion of the mass of the grommet "extrudes" towards the interior of the fitting during this "traveling" phenomena.

However, travel continues until full compression is reached, as in FIG. 20, where portions of the mass of the grommet extrude towards the interior of the fitting of the coaxial cable until the coaxial cable braid looped back portion 118B and the grommet nose region meet and intermingle. Specifically, this region of intermingling is designated by the reference numeral 148 in FIG. 20, which occurs because of an extrusion phenomenon during compression. Portions of the deformed grommet are compressed into the metallic braid of the coax, and substances of the grommet commingle with the metallic braiding of the coaxial cable sheath. The seal formed by material from grommet 67 thus travels into contact with the braid portion 118B (i.e., FIG. 20), and some of the resilient material of the grommet 67 is forced into the interstitial regions of the wire web of the sheath. As seen, for example, in FIG. 20, grommet deformation pressures the coaxial cable all around its periphery, and forms a seal.

At the same time, portions of the coaxial cable contacted by the grommet 67 are radially inwardly compressed into the groove 75 defined on the shank of the post 70.

Thus, the preferred special sealing grommet 67 disposed in the end cap of the fitting is uniquely shaped with a rounded bulbous convex "nose". This unique protrusion tends to grasp the outer, PVC jacket 117 and aids in locking the coaxial cable in position if unusual forces are applied to the coax. If the coaxial cable is accidentally pulled outwardly, (i.e., an axial pull), the surface friction between dissimilar materials (i.e., the post metal and the coaxial cable plastic) and deflection of the jacket 117 along with conductive braid 118 into the groove 75 resist pulling apart of the components, even without barbs on the post shank. Radial deformation presses radially inwardly on the periphery of the coax, causing extra locking pressure to be exerted and further resisting the accidental extraction of the coax.

Referring to FIG. 23, the grommet 67 is illustrated in the final compressed orientation that it assumes after full installation compression. The neck is deformed as indicated, by contact with the body shank. The squeezed and elongated body has been designated by the reference numeral 149 (FIG. 23). As portions of the cable contacted by the grommet 67 are radially inwardly compressed into the groove 75, sealing is enhanced.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An F-connector for coaxial cable, said connector comprising:

a nut adapted to be coupled to a threaded socket;

an elongated, hollow post including a shank, the shank comprising a groove;

a hollow tubular body coaxially disposed over said post;

a tubular end cap;

a sealing grommet disposed within said tubular end cap, wherein the sealing grommet comprises innermost and outermost portions that are integral and coaxial, the outermost portion forming the outer diameter of said grommet and having a generally squarish profile and a first grommet length enabling the grommet to snugly seat within the end cap, the innermost portion of the grommet being bulbous and comprising a convex nose aimed at the interior of the connector and having a second grommet length greater than said first grommet length, and the grommet comprises a neck disposed between said nose and said outermost portion; and, wherein, when the connector is compressed, said sealing grommet is deformed and elongated and portions of the grommet undergo a traveling phenomena thereby contacting and intermingling with portions of conductive braid associated with said coaxial cable and thereby urging at last a portion of said coaxial cable towards said groove.

2. The F-connector as defined in claim 1 wherein the post comprises a barbless shank.

3. The F-connector as defined in claim 1 wherein said first grommet length is approximately 90% of said second grommet length.

4. The F-connector as defined in claim 3 wherein said nose comprises a radius dimensioned approximately 8-10% of said second grommet length.

5. The F-connector as defined in claim 3 wherein said nose comprises a radius dimensioned approximately 9% of said second grommet length.

6. A compressible F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow post having a flanged end mechanically coupled to said nut and a reduced diameter shank adapted to be inserted into said prepared cable end around the center conductor insulation and coaxially beneath said outer conductive braid, the shank comprising a groove;

a hollow tubular body coaxially disposed over said post, the body having a front end disposed adjacent said nut, said body comprising an integral, elongated tubular shank and an internal passageway with a diameter greater than the diameter of said post such that an annular void is formed between said post and said body;

a tubular end cap comprising an open end and a terminal end, the end cap comprising a smooth hollow interior, and the end cap adapted to be slidably coupled to said body shank, the end cap comprising an interior passageway through which coaxial cable may pass;

an enhanced, generally toroidal sealing grommet disposed within said end cap, wherein the sealing grommet comprises innermost and outermost portions that are integral and coaxial, the outermost portion forming the outer diameter of said grommet and having a generally squarish profile and a first grommet length enabling the grommet to snugly seat within the end cap, the innermost portion of the enhanced grommet being bulbous and comprising a convex nose aimed at the interior of the connector and having a second grommet length greater than said first grommet length, and the grommet comprising a neck disposed between said nose and said outermost portion;

wherein an annular void exists between said post and said body in which the coaxial cable outer conductive braid is restrained between said post and said body and electrically conductively contacted by said post;

wherein the end cap is frictionally attached by compressively axially deflecting said end cap towards said nut such that it will lock along said shank, and wherein the coaxial cable end is axially restrained after end cap compression within said connector substantially by compression and deformation of said sealing grommet, with an uninsulated portion of the cable center conductor extending through said nut thereby forming the male part of the resulting electrical connection; and, wherein, when the connector is compressed, the body shank contacts the sealing grommet to squeeze and compress the sealing grommet, and a portion of the coaxial cable is radially urged towards said groove.

7. The F-connector as defined in claim 6 wherein the shank of said post is barbless.

8. The F-connector as defined in claim 6 wherein said first grommet length is approximately 80-100% of said second length.

9. The F-connector as defined in claim 6 wherein said first grommet length is approximately 90% of said second grommet length.

10. The F-connector as defined in claim 8 wherein said nose comprises a radius dimensioned approximately 8-10% of said second grommet length.

11. The F-connector as defined in claim 8 wherein said nose comprises a radius dimensioned approximately 9% of said second grommet length.

12. A compressible F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow post having a flanged end mechanically coupled to said nut and a reduced diameter shank adapted to be inserted into said prepared cable end around the center conductor insulation and coaxially beneath said outer conductive braid, the shank having a groove;

a hollow tubular body coaxially disposed over said post, the body having a rear end and a front end disposed adjacent said nut and an integral, elongated tubular shank comprising a smooth, cylindrical outer surface, the body having an internal passageway with a diameter greater than the diameter of said post such that an annular void is formed between said post and said body;

a tubular end cap comprising an open end and a terminal end, the end cap comprising a smooth hollow interior, and the end cap adapted to be slidably coupled to said body shank rear end and variably positioned as desired by a user, the end cap comprising an interior passageway through which coaxial cable may pass, and an internal ring groove adjacent the terminal end;

an enhanced, generally toroidal sealing grommet disposed within said internal ring groove within said end cap, the enhanced sealing grommet comprising innermost and outermost portions that are integral and coaxial, the outermost portion forming the outer diameter of said enhanced grommet and having a generally squarish profile establishing a first grommet length enabling the grommet to snugly seat within the end cap internal ring groove, the innermost portion of the enhanced grommet comprising a convex nose aimed at the interior of the connector and having a larger second grommet length, and the grommet comprising a neck disposed between said nose and said outermost portion;

wherein said first grommet length is approximately 80-100% of said second length;

wherein said nose comprises a radius dimensioned approximately 8-10% of said second grommet length;

wherein an annular void exists between said post and said body in which the coaxial cable outer conductive braid is restrained between said post and said body and electrically conductively contacted by said post;

wherein the end cap is frictionally attached by compressively axially deflecting said end cap towards said nut such that it will lock at any position along the cylindrical outer surface of said shank without assuming a predetermined detented position, and wherein the coaxial cable end is axially restrained after end cap compression within said connector substantially by compression and deformation of said enhanced sealing grommet, with an uninsulated portion of the cable center conductor extending through said nut thereby forming the male part of the resulting electrical connection; and, wherein, when the connector is compressed, the body shank contacts the neck of the enhanced sealing grommet to squeeze and compress the sealing grommet to force the grommet into sealing contact with the coaxial cable with portions of the grommet traveling to contact and intermingle with portions of said conductive braid and with at least a portion of said coaxial cable is forced into said post shank groove.

13. The F-connector as defined in claim 12 wherein the hollow interior of the tubular end cap includes teeth means for frictionally gripping the outer surface of said body shank.

14. The F-connector as defined in claim 12 wherein said first grommet length is approximately 80-100% of said second length.

15. The F-connector as defined in claim 12 wherein said first grommet length is approximately 90% of said second grommet length.

16. The F-connector as defined in claim 14 wherein said nose comprises a radius dimensioned approximately 8-10% of said second grommet length.

17. The F-connector as defined in claim 14 wherein said nose comprises a radius dimensioned approximately 9% of said second grommet length.

* * * * *